US010766661B2

(12) United States Patent
Perella et al.

(10) Patent No.: US 10,766,661 B2
(45) Date of Patent: Sep. 8, 2020

(54) FOLDABLE BOX

(71) Applicant: IdeaStream Consumer Products, LLC, Cleveland, OH (US)

(72) Inventors: Daniel V. Perella, Cleveland, OH (US); Benjamin Hietanen, Cleveland, OH (US); Zhenghong Li, Shenzhen (CN); Jensen Tuen, Fanling (HK); Jinyuan Li, Shenzhen (CN)

(73) Assignee: IdeaStream Consumer Products, LLC, Cleveland, OH (US)

( * ) Notice: Subject to any disclaimer, the term of this patent is extended or adjusted under 35 U.S.C. 154(b) by 43 days.

(21) Appl. No.: 15/926,542

(22) Filed: Mar. 20, 2018

(65) Prior Publication Data

US 2018/0244424 A1 Aug. 30, 2018

Related U.S. Application Data

(63) Continuation-in-part of application No. 15/829,170, filed on Dec. 1, 2017, now abandoned, which is a continuation-in-part of application No. 29/627,144, filed on Nov. 22, 2017, now abandoned, and a continuation-in-part of application No. 29/623,686, filed on Oct. 26, 2017, now abandoned, and a continuation-in-part of application No. 29/623,678, filed on Oct. 26, 2017, now abandoned, and a continuation-in-part of application No. 29/623,680, filed on Oct. 26, 2017, now abandoned, and a (Continued)

(51) Int. Cl.

| | |
|---|---|
| ***B65D 5/36*** | (2006.01) |
| ***B65D 5/24*** | (2006.01) |
| ***B65D 5/20*** | (2006.01) |
| ***B31B 50/81*** | (2017.01) |
| ***B31B 50/00*** | (2017.01) |
| ***B31B 50/62*** | (2017.01) |
| ***B31B 50/73*** | (2017.01) |
| ***B65D 5/66*** | (2006.01) |
| ***B65D 5/32*** | (2006.01) |
| *B31B 120/30* | (2017.01) |

(52) U.S. Cl.

CPC ..... *B65D 5/3664* (2013.01); *B31B 50/0044* (2017.08); *B31B 50/62* (2017.08); *B31B 50/73* (2017.08); *B31B 50/814* (2017.08); *B65D 5/2052* (2013.01); *B65D 5/241* (2013.01); *B65D 5/323* (2013.01); *B65D 5/6673* (2013.01); *B31B 2120/302* (2017.08); *B65D 2313/04* (2013.01)

(58) Field of Classification Search

CPC .... B65D 5/3664; B65D 5/2052; B65D 5/241; B65D 5/323; B65D 5/6673; B65D 2313/04; B31B 50/62; B31B 50/814; B31B 50/0044; B31B 50/73; B31B 2120/302

See application file for complete search history.

(56) References Cited

U.S. PATENT DOCUMENTS

| | | | | |
|---|---|---|---|---|
| 2,957,617 A | | 10/1960 | Bolding | |
| 6,029,885 A | * | 2/2000 | Mueller | B65D 5/22 229/125.19 |

(Continued)

*Primary Examiner* — Corey N Skurdal
(74) *Attorney, Agent, or Firm* — Fay Sharpe LLP

(57) ABSTRACT

A foldable box having a first, substantially flat and unfolded configuration which can be easily and conveniently transformed into a second, three-dimensional configuration capable of retaining one or more items.

23 Claims, 15 Drawing Sheets

Related U.S. Application Data continuation-in-part of application No. 29/623,683, filed on Oct. 26, 2017, now abandoned, and a continuation-in-part of application No. 29/623,689, filed on Oct. 26, 2017, now abandoned, and a continuation-in-part of application No. 29/623,688, filed on Oct. 26, 2017, and a continuation-in-part of application No. 29/623,693, filed on Oct. 26, 2017, now abandoned, and a continuation-in-part of application No. 29/613,487, filed on Aug. 10, 2017, and a continuation-in-part of application No. 29/613,491, filed on Aug. 10, 2017, now Pat. No. Des. 872,477, and a continuation-in-part of application No. 29/611,995, filed on Jul. 27, 2017, and a continuation-in-part of application No. 29/611,992, filed on Jul. 27, 2017, now Pat. No. Des. 850,908, and a continuation-in-part of application No. 29/612,002, filed on Jul. 27, 2017, now Pat. No. Des. 858,274, and a continuation-in-part of application No. 29/611,998, filed on Jul. 27, 2017, now Pat. No. Des. 887,265, and a continuation-in-part of application No. 29/610,397, filed on Jul. 12, 2017, now Pat. No. Des. 847,508, and a continuation-in-part of application No. 29/585,399, filed on Nov. 23, 2016, now Pat. No. Des. 829,097, and a continuation-in-part of application No. 29/585,394, filed on Nov. 23, 2016, now Pat. No. Des. 828,156, and a continuation-in-part of application No. 29/583,815, filed on Nov. 9, 2016, now Pat. No. Des. 833,867, and a continuation-in-part of application No. 29/583,811, filed on Nov. 9, 2016, now Pat. No. Des. 829,096.

(60) Provisional application No. 62/485,091, filed on Apr. 13, 2017, provisional application No. 62/476,914, filed on Mar. 27, 2017, provisional application No. 62/428,602, filed on Dec. 1, 2016, provisional application No. 62/428,606, filed on Dec. 1, 2016.

(56) References Cited

U.S. PATENT DOCUMENTS

| | | | | |
|---|---|---|---|---|
| 6,568,586 | B1 | 5/2003 | Van Esley et al. | |
| 7,481,355 | B2 | 1/2009 | Hui | |
| 7,681,782 | B2 * | 3/2010 | Bondarik | B65D 5/36 229/117.07 |
| 7,686,206 | B2 * | 3/2010 | Bondarik | B65D 5/36 229/117.08 |
| 8,573,471 | B2 | 11/2013 | Wong | |
| 8,960,527 | B2 | 2/2015 | Hui | |
| RE46,563 | E | 10/2017 | Wong | |
| 2004/0140345 | A1 | 7/2004 | Kao | |
| 2010/0006632 | A1 | 1/2010 | Conroy | |
| 2011/0121062 | A1 | 5/2011 | Hui | |
| 2012/0037693 | A1 | 2/2012 | Wong | |
| 2014/0231495 | A1 | 8/2014 | Wong et al. | |

* cited by examiner

FOLDABLE BOX

CROSS REFERENCE TO RELATED APPLICATIONS

This application is a continuation-in-part of U.S. patent application Ser. No. 15/829,170 filed Dec. 1, 2017, which claims the priority benefit of U.S. Provisional Patent Application Ser. No. 62/428,602, filed Dec. 1, 2016; U.S. Provisional Patent Application Ser. No. 62/428,606, filed Dec. 1, 2016; U.S. Provisional Patent Application Ser. No. 62/476,914, filed Mar. 27, 2017; and U.S. Provisional Patent Application Ser. No. 62/485,091, filed Apr. 13, 2017, all of which are incorporated herein by reference.

This application is also a continuation-in-part of U.S. patent application Ser. No. 15/829,170 filed Dec. 1, 2017, which a continuation-in-part of U.S. patent application Ser. No. 29/583,811 filed Nov. 9, 2016; U.S. patent application Ser. No. 29/583,815 filed Nov. 9, 2016; U.S. patent application Ser. No. 29/585,394 filed Nov. 23, 2016; U.S. patent application Ser. No. 29/585,399 filed Nov. 23, 2016; U.S. patent application Ser. No. 29/610,397 filed Jul. 12, 2017; U.S. patent application Ser. No. 29/611,998 filed Jul. 27, 2017; U.S. patent application Ser. No. 29/612,002 filed Jul. 27, 2017; U.S. patent application Ser. No. 29/611,995 filed Jul. 27, 2017; U.S. patent application Ser. No. 29/611,992 filed Jul. 27, 2017; U.S. patent application Ser. No. 29/623,678 filed Oct. 26, 2017; U.S. patent application Ser. No. 29/623,680 filed Oct. 26, 2017; U.S. patent application Ser. No. 29/623,683 filed Oct. 26, 2017; U.S. patent application Ser. No. 29/623,686 filed Oct. 26, 2017; U.S. patent application Ser. No. 29/623,688 filed Oct. 26, 2017; U.S. patent application Ser. No. 29/623,689 filed Oct. 26, 2017; U.S. patent application Ser. No. 29/623,693 filed Oct. 26, 2017; U.S. patent application Ser. No. 29/627,144 filed Nov. 22, 2017; U.S. patent application Ser. No. 29/613,487 filed Aug. 10, 2017; and U.S. patent application Ser. No. 29/613,491 filed Aug. 10, 2017, all of which are incorporated herein by reference.

The present invention is directed to a foldable box having a first, substantially flat and unfolded configuration which can be easily and conveniently transformed into a second, three-dimensional configuration capable of retaining one or more items.

BACKGROUND ON THE INVENTION

Boxes are used every day for many purposes such as storage and shipping. Typically, when boxes are manufactured by a manufacturing company, the boxes are manufactured and shipped in a three-dimensional form. The manufacturing company then must pay for additional shipping cost for empty space within the box. Additionally, the boxes are also more susceptible to damage when shipped in this fashion. To overcome the high shipping cost and inefficient shipping of such boxes, box designers have made collapsible boxes. These boxes are designed to be shipped flat and need to be constructed by the end user of the box. End user construction of these boxes often requires time-consuming processes such as the application of additional or extra materials (e.g., glue, tape, etc.). These actions can be complicated, time-consuming, and labor intensive to the end user, thereby making the assembly of such boxes undesirable.

Non-limiting examples of such prior art foldable boxes include U.S. Patent Publication Nos. 2004/0140345; 2006/0151856; 2010/0006632; 2011/0121062; 2012/0037693 and 2014/0231495, and U.S. Pat. Nos. 2,957,617; 6,568,586; 8,573,471; 8,960,527 and RE 46563, all of which are incorporated herein by reference.

In view of the current state of foldable boxes, there is a need for a foldable box having one or more interchangeable configurations, and which can be easily and conveniently transformed between such interchangeable configurations thereby minimizing the time required for assembly and/or disassembly of the foldable box.

SUMMARY OF THE INVENTION

The present invention is directed to a foldable box having one or more interchangeable configurations, and which can be easily and conveniently transformed between such interchangeable configurations, thereby minimizing the time required for assembly and/or disassembly of the foldable box.

In one non-limiting aspect of the present invention, there is provided a foldable box having a plurality of interchangeable configurations. In one non-limiting aspect of the present invention, there is provided a foldable box having a first, unfolded configuration in which the foldable box is substantially flat, and a second, folded and/or three-dimensional configuration in which the foldable box is fully assembled. As described above, the first and second configurations of the foldable box are interchangeable. For example, the first configuration (i.e., the flat, unfolded foldable box) can be easily and conveniently transformed into the second configuration (i.e., the folded, three-dimensional foldable box), and, similarly, the second configuration can be easily and conveniently transferred into the first configuration; however, this is not required.

The materials used to form the foldable box are non-limiting. The foldable box can be formed from a single type of material; however, this is not required. As can be appreciated, the foldable box can be formed from one or more types of material. Generally, the foldable box is formed from a moderately rigid material such as, for example, a heavy weight cardboard material or paperboard material; however, this is not required. As can be appreciated the foldable box can be formed from other or alternative materials (e.g., flexible materials, semi-rigid materials, medium weight cardboard, fiberboard, rigid plastic, flexible plastic, composite materials, metal, wood, etc.). The material of the foldable box is typically selected so as to allow folding, bending, or other manipulations of the foldable box without losing the structural integrity of the material; however, this is not required. In one non-limiting configuration, the thickness of the material used to form the foldable box can be from about 0.01 mm to about 10 mm (and all values and ranges therebetween), more particularly about 1-3 mm; however, this is not required.

In another and/or alternative non-limiting aspect of the present invention, the material of the foldable box can be lined with one or more additional types of material; however, this is not required. In one non-limiting embodiment, the material of the lining is a laminate material; however, other or alternative liners can be used (e.g., cloth, cloth-like materials, tape, tape-like materials, plastic material, fabric material, paper, etc.). Generally, the lining (when used) is configured to substantially or completely cover at least a first surface of the foldable box; however, this is not required. In one non-limiting configuration, the lining completely covers a first surface of a portion of the foldable box, wraps around the perimeter thereof, and terminates at a position at or near the perimeter on a second surface of the portion of the foldable box; however, this is not required. The lining can be used to provide an aesthetically pleasing appearance to one or more users of the foldable box, and/or to provide reinforcement to one or more components of the box; and/or to cover or hide from view one or more portions of the box; however, this is not required. As such, the lining can include designs, surface structures, etc. on a surface thereof; however, this is not required. The lining (when used) typically has a thickness less than or equal to the material used to form the foldable box; however, this is not required. As such, the lining can be configured to provide support to the foldable box; however, this is not required. The lining can be used to connect together one or more pieces of the foldable box (e.g., connect together multiple pieces of paperboard panels that are used to form one or more sides of the foldable box, etc.), and/or be used to form a hinge or foldable region between two or more pieces of the foldable box; however, this is not required.

The shape of the foldable box is non-limiting. In one non-limiting configuration, the shape of the top plan view of the foldable box in its first, unfolded configuration is rectangular or square; however, the shape of the top plan view foldable box in its first, unfolded configuration can have other shapes. In another and/or alternative non-limiting configuration, the shape of the top plan view of the foldable box in its second, three-dimensional configuration is rectangular or square; however, the shape of the top plan view of the foldable box in its second, three-dimensional configuration can have other shapes. Similarly, the size of the foldable box in its folded and unfolded configuration is non-limiting. In one specific non-limiting configuration, when the foldable box in the folded configuration has a top plan rectangular shape, the dimensions of the foldable box can be about 1-20 inches in height (and all values and ranges therebetween) by about 2-40 inches in width (and all values and ranges therebetween) by about 1-40 inches in length (and all values and ranges therebetween); however, the foldable box can have other dimensions. In one specific non-limiting configuration, when the foldable box in the folded configuration has a top plan square shape, the dimensions of the foldable box can be about 1-20 inches in height (and all values and ranges therebetween) by about 2-40 inches in width (and all values and ranges therebetween) by about 2-40 inches in length (and all values and ranges therebetween); however, the foldable box can have other dimensions.

In one non-limiting aspect of the present invention, there is provided a foldable box having a first set of panels and a second set of panels; however, this is not required. The second set of panels is configured to be foldably connected to the first set of panels; however, this is not required. This non-limiting configuration provides a non-limiting advantage in that all components of the foldable box are connected such that no further assembly is required by the end user, a common disadvantage of many existing foldable box types in which at least one component must typically be assembled separately and connected to the remaining portion of a box. This non-limiting configuration also has the advantage that the foldable box, after being assembled into its folded configuration, can later be unassembled into its original unfolded position. Foldable boxes that require the permanent connection of one or more components during assembly cannot thereafter be unassembled into its original unfolded position without having to damage one or more portions of the foldable box, and then later be reused without having to damage the assembled box. As defined herein, damage means having to tear apart or cut a portion of a box or otherwise have to disfigure a portion of the box so that is can be unfolded into a flat position.

In another and/or alternative non-limiting aspect of the present invention, the first set of panels further comprises a front panel, a bottom panel, a back panel, a top panel and a top end panel arranged in a predetermined sequence; however, this is not required. In one non-limiting configuration, the front panel, bottom panel, back panel, top panel, and top end panel are defined portions in a single piece of material; however, this is not required. In such a configuration, the front panel, bottom panel, back panel, top panel and top end panel can include precut regions (e.g., precut grooves), scoring, creasing, etc. to facilitate in the folding of one or more portions of the panels; however, other or alternative methods can be used. The precut regions, scoring, creasing, etc. (when used) also can be used to provide foldable connections or regions between adjacent panels of the first set of panels. The size and shape of the foldable connections are non-limiting. Generally, the foldable connections are configured to permit from about 1° to about 180° angles of relative rotation between adjacent panels; however, this is not required. For example, from a flat, unfolded configuration, the connection arrangements can permit the front panel to be rotated about 90° relative to the bottom panel, the back panel to be rotated about 90° relative to the bottom panel, the back panel to be rotated about 90° relative to the top panel, and the top end panel to be rotated about 90° relative to the top panel; however, this is not required. As such, when the foldable box is in its first, unfolded configuration, the front panel, bottom panel, back panel, top panel and top end panel are configured to lay substantially flat and, in its second, three-dimensional configuration, the foldable box can be folded such that the top end panel is parallel to the front and back panels, and the top panel is parallel to the bottom panel. Thus, the front panel, bottom panel, back panel, top panel and top end panel of the first set of panels are foldably connected in a predetermined sequence along a crease and/or fold; however, this is not required. In such a configuration, the front panel is foldably connected to the bottom panel along a first crease, the back panel is foldably connected to the bottom panel along a second crease, the back panel is foldably connected to the top panel along a third crease, and the top end panel is foldably connected to the top panel along a fourth crease; however, this is not required. As can be appreciated, when a liner or a separate hinge or a hinge material is used, the liner or the separate hinge or the hinge material can be used to allow separate panels to be connected together and folded with respect to one another; however, this is not required.

The size and shape of each of the panels in the first set of panels is non-limiting. In one non-limiting configuration, each of the panels in the first set of panels is rectangular or square, thereby providing a substantially rectangular or square box when folded/assembled and viewed from the top plan view; however, this is not required. The first set of panels of the foldable box can include panels of one or more different sizes; however, this is not required. In one non-limiting configuration, the first set of panels comprises a bottom panel and a top panel which are greater in size that the front panel, the back panel and the top end panel; however, this is not required. In another and/or alternative non-limiting configuration, the front panel, back panel and top end panel are the same or similar in size and shape; however, this is not required.

In another and/or alternative non-limiting aspect of the present invention, the second set of panels further comprises a left side panel and a right side panel. Generally, the left and right side panels are formed from separate pieces of material; however, this is not required. The size and shape of the left and right side panels are non-limiting. In one non-limiting configuration, the left and right side panels are rectangular in shape and formed from the same material as the first set of panels; however, this is not required. The second set of panels are configured to be adhesively and/or foldably connected to the first set of panels; however, this is not required. As can also be appreciated, the second set of panels can be configured to be snap connected to the first set of panels; however, this is not required.

A lining material can optionally be applied to the left and right side panels; however, this is not required. The lining material can be applied such that a portion of the lining material extends at least partially over the lengthwise edge of the left and right side panels, thereby forming an attachment portion suitable for facilitating attachment of the left and right side panels to the first set of panels; however, this is not required. For example, the attachment portion of the left and right side panels can be connected (e.g., glue, tape, adhesive, tack, staple, melted connection, hook and loop fastener, snap, etc.) at or near oppositely disposed edges of the bottom panel of the first set of panels; however, this is not required. As such, the attachment portion of the second set of panels provides a foldable and adhesive connection to the first set of panels. As can be appreciated, the attachment portion of the second set of panels can include a snap connection to the first set of panels.

In another and/or alternative non-limiting aspect of the present invention, the foldable box optionally incorporates a plurality of foldable connectors. In one non-limiting configuration, the lining material is applied to the left and right side panels such that the lining material extends at least partially over the side edges of the left and right side panels, thereby forming a plurality of foldable connectors. The plurality of foldable connectors can be foldable relative to the side edges of the left and right side panels, and provide a connection means wherein the left and right side panels can be connected to the first set of panels; however, this is not required. The inherent flexibility, durability and flexibility of lining materials provides a suitable hinge and/or foldable connection; however, this is not required. The connection arrangements are configured to connect the left and right side panels to the front and back panels to facilitate lifting of the front and back panels when the left and right side panels are lifted; however, this is not required. As such, the front panel, back panel and left and right side panels can be lifted in unison to an upright position relative to the bottom panel; however, this is not required and the work required by the end user of the box is significantly minimized. Furthermore, the end user does not need to apply any additional glue and/or tape to the foldable box.

The shape and size of each of the plurality of foldable connectors are non-limiting. Generally, all the foldable connectors are the same in size and shape; however, this is not required. In one non-limiting configuration, each foldable connector comprises a generally square shape having a diagonal crease and/or groove thereby providing a first and second connectable section. The outside surface of a first connectable section can be configured to be connected to an interior surface of the front and/or back panel. In one specific non-limiting configuration, a first connectable section of a first foldable connector of the right side panel is connected to the back panel, a first connectable section of a second foldable connector of the right side panel is connected to the front panel, a first connectable section of a first foldable connector of the left side panel is connected to the back panel, and a first connectable section of a second foldable connector of the left side panel is connected to the front panel; however, this is not required. The type of connection used is non-limiting. For example, the outside surface of the first connectable section can be connected to the interior surface of the front and/or back panel via an adhesive such as, for example, glue, tape, hook and loop fastener, melted connection, staple, tack, snap, magnet, etc.; however, this is not required. The second connectable section can be configured to be connected along an edge to a side edge of the left and/or right side panel.

In another and/or alternative non-limiting configuration, the outside surface of the second connectable section can also be configured to be connected to the interior surface of the front and/or back panel; however, this is not required. In one non-limiting configuration, the outside surface of the second connectable section of each foldable connector can include an adhesive material; however, this is not required. The adhesive material (when used) can be positioned on or closely adjacent to one or more edges of the second connectable region and can cover a majority of the second connectable region; however, this is not required.

Generally, the adhesive material is a preapplied material that includes a removable top protective release liner that, when removed, exposes a top adhesive surface of the adhesive material. One non-limiting advantage to providing a preapplied adhesive material is that the end user does not need to apply any additional materials to the foldable box prior to its use. When exposed, the top adhesive surface of the adhesive material is configured to bond with a portion of the front and/or back panels that is positioned at or near the second connectable section; however, this is not required. In such a configuration, when the foldable box is converted into its second, three-dimensional structure, the adhesive material on the outside surface of the second connectable section can at least partially hold the foldable box in a three-dimensional configuration; however, this is not required. As can be appreciated, other or alternative releasable connection arrangements can optionally be used to connect the second connectable region of each foldable connector to the front and/or back panels; however, this is not required. As can be appreciated, the adhesive connection can be configured to form a permanent connection with a portion of the front and/or back panels that is positioned at or near the second connectable section so as to permanently hold the foldable box in the three-dimensional configuration; however, this is not required. As can also be appreciated, the adhesive connection can be configured to form a releasable and reusable connection with a portion of the front and/or back panels that is positioned at or near the second connectable section so the foldable box can be unfolded from the three-dimensional configuration back to the unfolded configuration; however, this is not required.

In another and/or alternative non-limiting aspect of the present invention, the foldable box includes a protective material provided on one or more surfaces of the foldable box; however, this is not required. The type of protective material is non-limiting. The protective material can be the same or different than the lining (when used); however, this is not required. In one non-limiting configuration, the protective material is a durable paper material; however, other or alternative types of materials can be used (e.g., fabric, composition material, plastic, metal, wood, fiberglass, etc.). In one non-limiting configuration, the protective material can be applied to a second surface of the first set of panels via an adhesive (e.g., glue, tape, etc.); however, other or alternative connection arrangements can be used (melted connection, tack, staple, snap, etc.). Alternatively, the protective material can be a layer of tape; however, this is not required. The protective material (when used) is configured to cover a majority of the second surface of the first set of panels; however, this is not required. In one non-limiting configuration, the protective material is applied to the second surface of the first set of panels such that the protective material extends at least partially over the portion of the lining which terminates at or near the perimeter of the first set of panels; however, this is not required. In addition to providing improved durability and structural rigidity to the panels of the foldable box, the protective material also provides improved support at or near the foldable connections (i.e., creases and/or folds) between panels of the first set of panels. Optionally, all of the panels includes a protective material; however, this is not required.

In another and/or alternative non-limiting aspect of the present invention, the foldable box can include a connection arrangement provided between the top end panel and the front panel such that, when the foldable box is transformed into its second, three-dimensional configuration, the top end panel can releasably connect to the front panel; however, this is not required. As such, the connection arrangement between the top end panel and the front panel is capable of at least partially retaining the foldable box in its second, three-dimensional configuration; however, this is not required.

The type of connection arrangement used between the top end panel and the front panel is non-limiting. In one non-limiting configuration, a magnetic connection arrangement is used; however, this is not required. In such a configuration, the top end panel can include one or more magnets (or magnetically-attractive materials) and the front panel can include one or more magnets (or magnetically-attractive materials) corresponding to the one or more magnets (or magnetically-attractive materials) of the top end panel; however, this is not required. As can be appreciated, other connection arrangements can be used (e.g., releasable adhesive, hook and loop fastener, latch, snap, button, etc.). When two or more magnets are used, the magnets generally have opposite polarity. In one non-limiting configuration, the magnets are positioned within the material of the front panel and the top end panel, spaced apart from the edge of the front and top end panels and the lining; however, this is not required. This size, shape and configuration of the magnets are non-limiting. In one non-limiting configuration, the thickness of each magnet is selected to be about the same or less than the thickness of the material of the panels such that the magnets are completely enclosed; however, this is not required. As such, the magnets are provided within the material of the front and top end panels so that the magnets are not visible to a user. In another configuration, one panel includes one or more magnets and the other panel includes a material that is magnetically attracted to a magnetic (e.g., iron material, etc.).

In another and/or alternative non-limiting aspect of the present invention, the foldable box is configured to be easily and conveniently converted from a flat, unfolded configuration to a three-dimensional configuration. In operation, a user can lift the left and right side panels upward towards a vertical orientation. In doing so, the front and back panels will be also be caused to be rotated or pivot upwards to a vertical orientation via the plurality of connection arrangements connecting the right and left side panels of the second set of panels to the front and back panels of the first set of panels; however, this is not required. As such, the foldable box can be easily and conveniently changed from an unfolded position to a three-dimensional configuration. When the foldable box is in its three-dimensional configuration, the foldable box can be filled with one or more items to be stored and/or held within the foldable box.

In another and/or alternative non-limiting aspect of the present invention, the foldable box can optionally be folded from its flat, unfolded configuration into a space-saving, compact configuration; however, this is not required. The compact configuration (when used) can facilitate space-saving storage and/or transport of one or more foldable boxes; however, this is not required. In one non-limiting configuration, when the compact configuration is used, the gap between the top panel and the back panel is generally configured to permit about 180° rotation, thereby accommodating the combined thicknesses of the back panel, the top panel and the left and/or right side panels; however, this is not required.

In another and/or alternative non-limiting aspect of the present invention, the first set of panels of the foldable box can optionally comprise a plurality of individual panels which can be attached (e.g., glued, taped, melted connection, hook and loop fastener, etc.) to one surface of a liner (e.g., cover, laminate material, etc.) with small gaps and/or spaces between adjacent individual panels; however, this is not required. The small gaps and/or spaces (when used) can provide the foldable connection between individual panels of the first set of panels; however, this is not required. In such a configuration, the first and second sets of panels can optionally be laminated together; however, this is not required. In such a configuration, the left and right side panels are spaced apart from the bottom panel; however, this is not required. The small gap and/or space between the left and right side panels can be configured to provide the foldable connection between the left and right side panels and the bottom panel of the foldable box; however, this is not required. In one non-limiting configuration, the left and right side panels are foldably connected at or near the side edges of the bottom panel; however, this is not required. In one specific non-limiting embodiment, the left and right side panels are spaced inward a predetermined distance from the side edges of the bottom panel; however, this is not required. Generally, the space between the left and/or right side panels and the bottom panel is configured to permit the left and/or right side panels to rotate about 70-150° relative to the bottom panel; however, this is not required. As such, in a three-dimensional configuration, the left and right side panels can be moved to be parallel to each other; however, this is not required.

In another and/or alternative non-limiting aspect of the present invention, there is provided a method for manufacturing a foldable box in accordance with the present invention. As described above, the foldable box can be formed from a first set of panels and a second set of panels; however, this is not required. The method for manufacturing the foldable box of the present invention can include: 1) selecting a material suitable for use in a foldable box, 2) cutting the selected material into a first and second set of panels having a desired size and shape, 3) optionally applying a lining material to at least a first surface of the first set of panels, 4) optionally applying a lining material to at least a first surface of the second set of panels forming at least one attachment portion and at least one foldable connector, 5) optionally applying a protective cover to at least a first surface of the first and/or second set of panels, 6) defining one or more panels within the first set of panels, 7) forming foldable connections between the one or more panels defined within the first set of panels by some means (e.g., cutting, scoring, folding the first set of panels, forming a hinge between the first set of panels, etc.), and/or 8) connecting the second and third set of panels to the first set of panels. The method for manufacturing a foldable box can further comprise the steps of: a) connecting a first portion of the at least one foldable connector to the first set of panels, and/or b) applying a snap or an adhesive having a removable protective liner or use some other type of connector to a second portion of the at least one foldable connector.

In another and/or alternative non-limiting aspect of the present invention, there is provided a method for transforming the foldable box of the present invention from its first, unfolded configuration to its second, three-dimensional configuration. Initially, the foldable box is provided in an unfolded configuration wherein the first set of panels is substantially flat (i.e., the front panel, bottom panel, back panel, top panel and top end panel foldable connections are all at approximately 180°), and the second set of panels lays on top of the first set of panels. The left and right side panels can be lifted upwards, thereby rotating the left and right side panels relative to the bottom panel. In lifting the left and right side panels upwards, the back and front panels of the first set of panels are caused to lift upwards, thereby also rotating the back and front panels relative to the bottom panel. The protective release liner (when used) can be removed from the preapplied adhesive material, thereby exposing the adhesive surface of the adhesive material of the foldable connectors. The left and right side panels are lifted upwards until they reach an approximately vertical position (i.e., about 90° relative to the bottom panel) wherein the adhesive surface of the adhesive material contacts and bonds with a portion of the front and/or back panels. A snap arrangement can also or alternatively be used. The top panel can then be rotated relative to the back panel such that the top panel covers the opening formed by the bottom panel, left side panel, right side panel, back panel and front panel. The top end panel can be rotated relative to the top panel to form a releasable connection. For example, when one or more magnets are provided in the top end panel and/or front panel and are caused to approach one or more connectors (e.g., magnet, hook and loop fastener, etc.) provided on or in the other panel of the foldable box, the magnetic force between the one or more magnets on the top end panel and/or the front panel is sufficient to releasably and securely close the foldable box in a three-dimensional configuration.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF NON-LIMITING EMBODIMENTS

The present invention is directed to a foldable box 10 having one or more interchangeable configurations, and which can be easily and conveniently transformed between such interchangeable configurations, thereby minimizing the time required for assembly and/or disassembly of the foldable box 10.

The foldable box 10 has a plurality of interchangeable configurations. In one non-limiting aspect of the present invention, there is provided a foldable box 10 having a first, unfolded configuration in which the foldable box 10 is substantially flat, and a second, folded and/or three-dimensional configuration in which the foldable box 10 is fully assembled. As described below, the first and second configurations of the foldable box 10 are interchangeable. For example, the first configuration (i.e., the flat, unfolded foldable box 10) can be easily and conveniently transformed into the second configuration (i.e., the folded, three-dimensional foldable box 10), and, similarly, the second configuration can be easily and conveniently transferred into the first configuration; however, this is not required.

Figure 1:
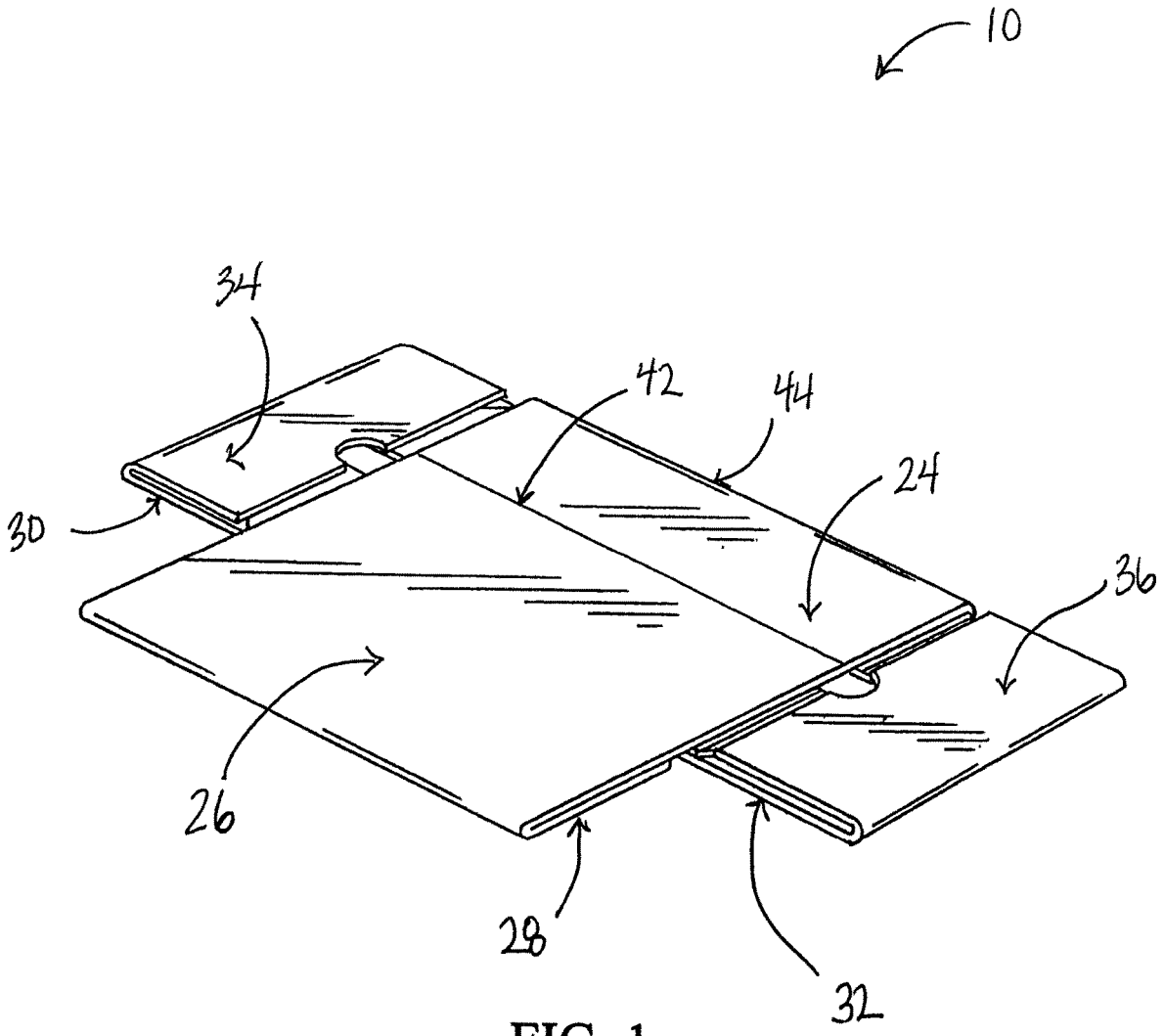
FIG. 1 is a top perspective illustration of a foldable box in a flat configuration in accordance with one non-limiting aspect of the present invention.
Figure 1A:
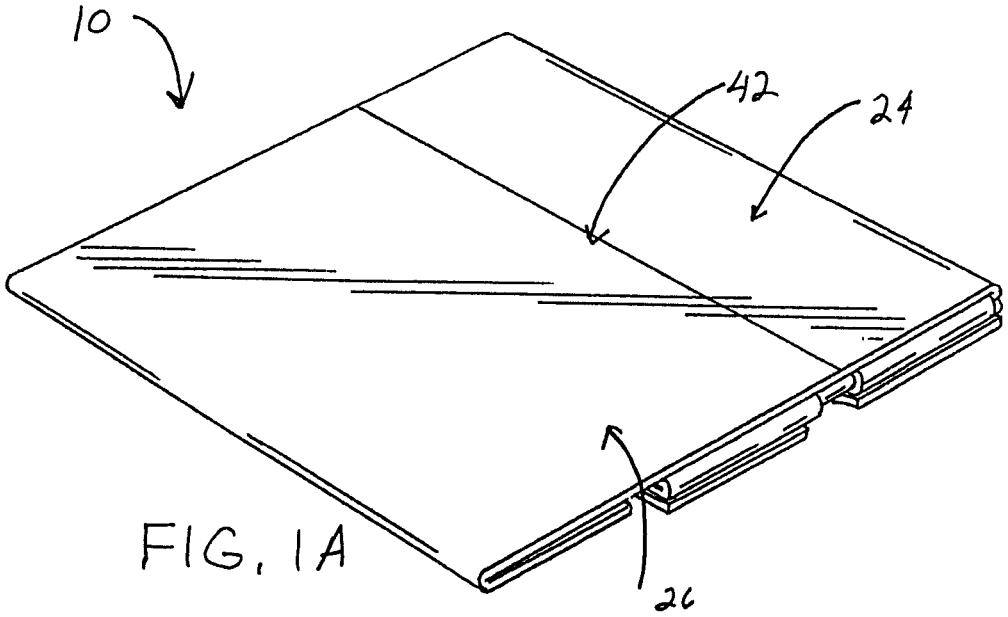
FIG. 1A is a top perspective illustration of the foldable box of FIG. 1 in the fully folded form.

With reference to FIGS. 1-6, there is illustrated a foldable box 10 in accordance with the present invention. As illustrated in FIG. 1A, the foldable box 10 is illustrated in a first fully folded configuration. When the foldable box 10 is in its first fully folded configuration, each section of the box is able to fold upon one or more other sections of the box, thereby minimizing the box's physical footprint and maximizing its storability. In this first fully folded configuration, the foldable box 10 lays substantially flat. In particular embodiments, the foldable box 10 in its first fully folded configuration may have a top profile of a square or rectangular shape, as seen in FIG. 1A. In other embodiments, the foldable box 10 in its first fully folded configuration may take other shapes, such as a T-shape.

Figure 2:
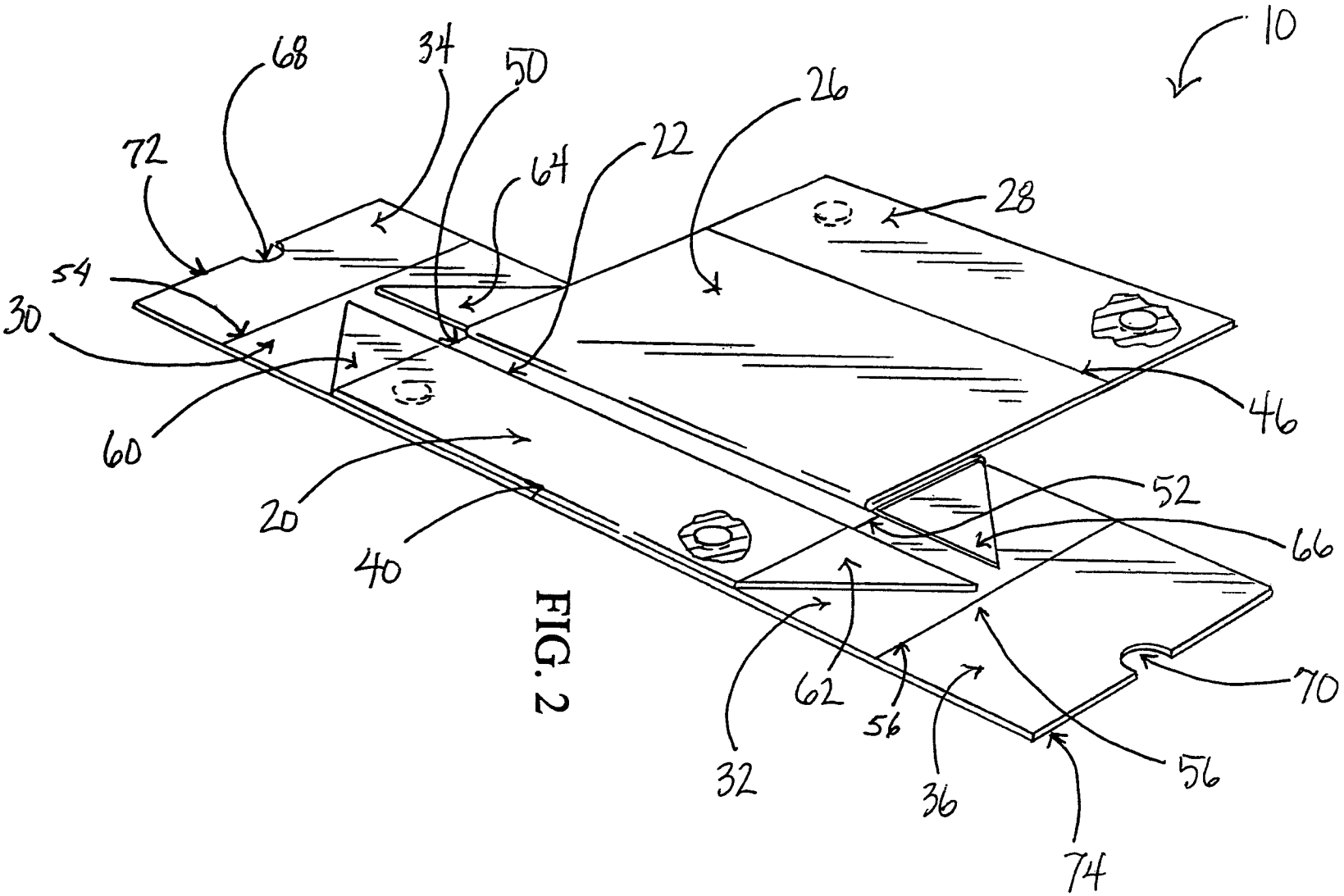
FIG. 2 is a bottom perspective illustration of the foldable box of FIG. 1 in its transition from a flat, unfolded configuration into its folded, three-dimensional configuration.

The foldable box 10 can comprise two or more sets of panels, each set of panels comprising a plurality of individually formed panels that are foldable in a pre-defined sequence to transform from a first, folded and flat configuration, into a second three-dimensional and assembled, configuration. In particular embodiments, the foldable box 10 may comprise a first set of panels and a second set of panels. As seen in FIGS. 1 and 2, the first set of panels may comprise a first front panel 20, a second front panel 28, a bottom panel 22, a back panel, and a top panel 26. In particular embodiments, the second set of panels includes at least a left panel 30 and a right panel 32, which are connected to one or more panels of the first set of panels. In some embodiments, the second set of panels may further include additional panels, such as panels 34, 36, 60, 62, 64 and 66, as illustrated in FIGS. 1 and 2.

In accordance with the present disclosure, each panel can be formed from a moderately rigid panel material, such as, for example, a heavy weight cardboard material or a paperboard material. However, the foldable box 10 may also be formed from alternate materials, such as, for example, a flexible material, a semi-rigid material, a medium weight cardboard, fiberboard, rigid plastic, flexible plastic, composite materials, metal, or wood. The panel material may be selected so as to allow folding, bending, and/or other manipulations of the foldable box 10 without the box losing its structural integrity. In particular embodiments, the thickness of the material used to form the panels (e.g. panels 20, 22, 24, 26, 28, 30, 32, 34, and 36) may be from about 0.01 mm to about 10 mm thick.

In particular embodiments, each panel within the first set of panels may be irreversibly or permanently connected to one or more other panels within the first set of panels. Likewise, each panel within the second set of panels may be irreversibly or permanently connected to one or more other panels within the second set of panels. As such, the box does not include separate unconnected panels that are not connected to at least one other panel of the box. In some embodiments, each panel of the first set of panels is connected via a foldable connector, i.e., a connection type that allows for the folding, bending, and/or manipulation of the panels without loss of structural integrity. As seen in FIGS. 1 and 2, the first front panel 20 may be connected to the bottom panel 22 along a first foldable connector 40, the bottom panel 22 may be connected to the back panel along a second foldable connector 42, the back panel may be connected to the top panel 26 along a third foldable connector 44, and the top panel 26 may be connected to the second front panel 28 along a fourth foldable connector 46.

The foldable connectors (e.g., connectors 40, 42, 44, 46, 48, 50, 52, 54, 56) can allow the connected panels a particular range of rotation relative to the other panels of the foldable box 10. In particular embodiments, the foldable connectors 40, 42, 44, 46, 48, 50, 52, 54, 56 can permit two adjacent and connected panels to rotate from about 1° to about 360° (and all values and ranges therebetween) relative to the position of the other. For example, the fourth foldable connector 46 that foldably connects the top panel 26 of the first set of panels and the second front panel 28 of the first set of panels, can allow the second front panel 28 to rotate from about 1-180° relative to the top panel 26. In other embodiments, the foldable connectors 40, 42, 44, 46, 48, 50, 52, 54, 56 can permit two adjacent and connected panels to rotate from about 1-180° relative to the position of the other. For example, the second front panel 28 may, in the first configuration of the foldable box 10, be folded to be parallel with the top panel 26, as seen in FIG. 1, and then rotate at least approximately 180° relative to the top panel 26, as seen in FIG. 2.

In some embodiments, one or more of the foldable connectors may be formed from a first liner layer (the liner layer made from a laminate or liner material) which covers contiguous portions of at least two or more adjacent panels. That is, one or more of the foldable connectors may be formed by attaching (e.g., adhering or otherwise affixing) a laminate material to the surface of two or more adjacent, individually formed panels, the laminate material extending from one adjacent panel to another. In particular embodiments, the laminate material may be applied to the surface or a portion of the surface of two or more panels such that there is a space between the panels, thereby forming an irreversibly foldable connector. Generally, the space is about 0.5-10 millimeters (and all values and ranges therebetween).

The panels of the second set of panels may also include irreversible foldable connectors. For example, with reference to FIG. 2, the left panel 30 and the right panel 32 can optionally be connected to at least one panel of the first set of panels via an irreversible foldable connector formed from a liner layer. In particular embodiments, the left panel 30 and right panel 32 may be connected to the bottom panel 22 of the first set of panels along a fifth foldable connector 50 and sixth foldable connector 52, respectively. The fifth and/or sixth foldable connectors may be formed from the first liner layer. In further embodiments, where the second set of panels also includes a left-side connection panel 34 and a right-side connection panel 36 as shown in FIGS. 1 and 2, the left-side connection panel 34 may be connected to the left panel 30 along a seventh foldable connector 54 formed from a liner layer, and the right-side connection panel 36 may be connected to the right panel 32 along an eighth foldable connector 56 formed from a liner layer.

Figure 3:
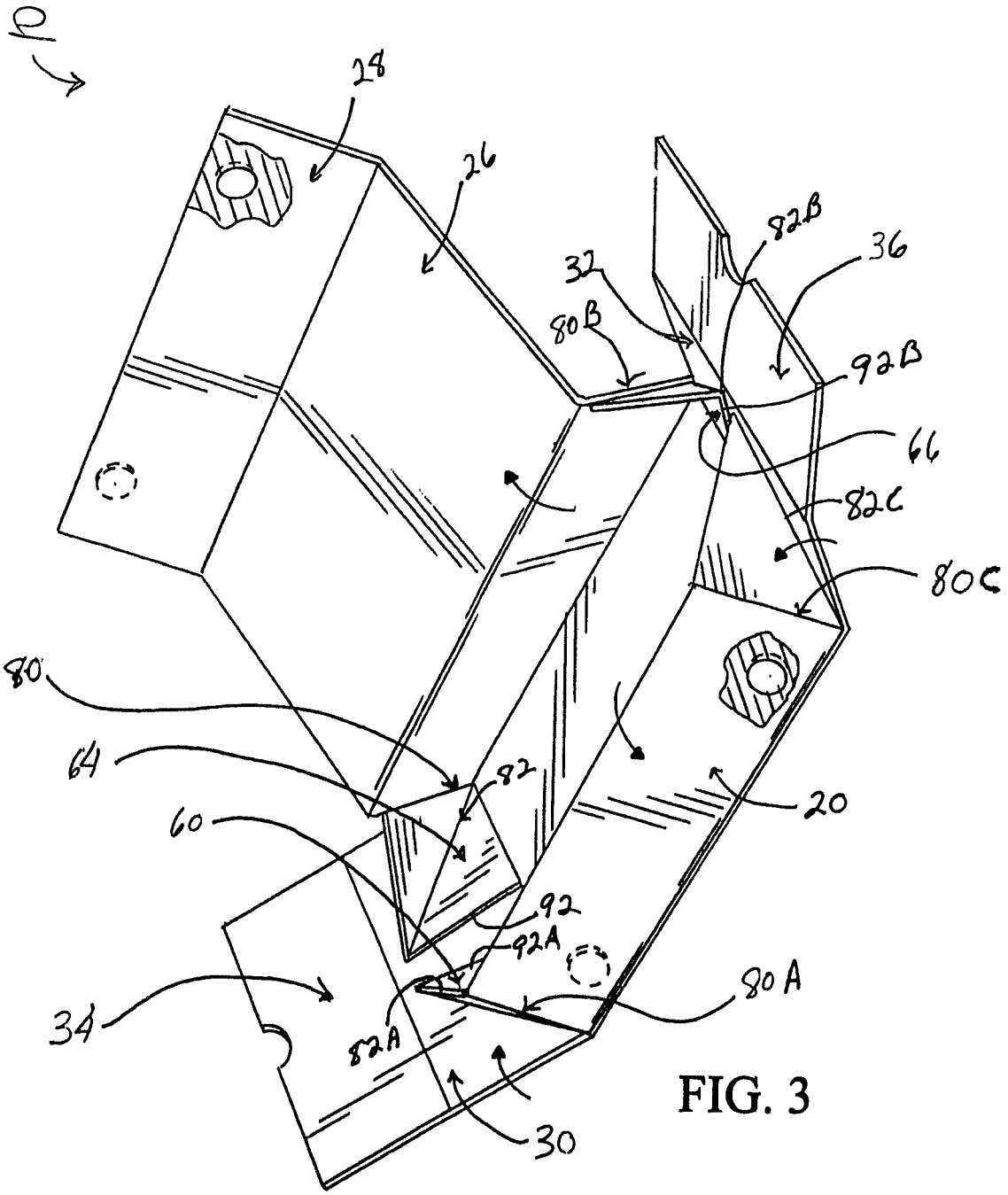
FIG. 3 is a perspective illustration of the foldable box of FIGS. 1-2 in its transition from a flat, unfolded configuration into its folded, three-dimensional configuration.

Additionally, one or more of the panels of the foldable box 10 can optionally include a hole and/or cutout 68, 70 to assist in the transformation of the foldable box 10 from its first configuration into its second configuration by permitting the easy and convenient disassembly of the three-dimensional configuration of the foldable box 10 into its flat, unfolded configuration, as seen in FIGS. 1-5. In particular embodiments, the hole and/or cutout 68, 70 (when used) is provided at or near an edge of a panel. For example, as illustrated in FIGS. 2 and 3, the holes and/or cutouts 68, 70 are provided along edge 72 of the left-side connection panel 34, opposite the seventh foldable connector 54, and along edge 74 of the right-side connection panel 36, opposite the eighth foldable connector 56. However, a hole and/or cutout may be present in other panels of the foldable box 10, such as the second front panel 28, thereby permitting easy and convenient lifting of the second front end panel from the first front panel 20. In some embodiments, the cutouts 68, 70 may be semi-circular in shape. In other embodiments, the cutouts 68, 70 may have a rectangular shape, a square shape, or a polygonal shape. As illustrated in FIG. 2, the cutout 68, 70 has a generally half-circle shape and is located at the bottom middle end of the panel 34, 36.

As described above, the foldable boxes 10 described herein may include two or more foldable connectors, each connector connecting two panels together. In particular embodiments, the two or more foldable connectors can include connectors formed from at least a second liner layer, such as from a laminate material that covers contiguous portions of at least two or more adjacent panels. In some embodiments, the two or more foldable connectors may include foldable connectors that connect a panel from the second set of panels to a panel from the first set of panels with which it is not otherwise directly connected. That is, one or more of the panels from the second set of panels may be directly connected to at least one panel from the first set of panels via a first connection means and at least a second, different, panel from the first set of panel via a second, different, connection means. For example, with reference to FIGS. 2 and 3, the foldable box 10 may include a ninth foldable connector 60, a tenth foldable connector 62, an eleventh foldable connector 64, and a twelfth foldable connector 66. Each of the foldable connectors 60, 62, 64, 66 may be formed from a second liner layer or laminate material extending from one of the panels of the second set of panels to at least one panel from the first set of panels. As illustrated in FIGS. 2 and 3, the ninth foldable connector 60 connects the left panel 30 of the second set of panels to the first front panel 20 of the first set of panels along edge 84, and also connects the left panel 30 to the bottom panel 22 of the first set of panels along a second edge (not visible). A first region 80 of the foldable connector is attached to the left panel 30 (e.g., by an adhesive, melted connection, snap, hook and loop fastener, etc.), while a second region of the foldable connector is not adhered to the left panel 30, but connects to the first front panel 20 along edge 84. As a result, the foldable connector is able to seamlessly and reversibly fold up and/or down as the foldable box is transformed from its first configuration to its second configuration. Similarly, foldable connectors 60, 62, 64, 66, each have regions 92, 92B that are attached (e.g., adhered, etc.) to their respective panels from the first set of panels, and regions 80, 80A, 80B, 80C that are not adhered to their respective panels from the second set of panels but connect to their respective panels from the first set of panels, and foldable regions 82, 82A, 82B, 82C in the panel itself. In other embodiments, the foldable connectors 60, 62, 64, 66 may be arranged in different ways. For example, the foldable connectors 60, 62, 64, 66 connecting the left and right panels 32 of the second set of panels to the first front panel 20 and back panel of the first set of panels have edges (others not visible) that terminate along the edge of the left and right panels 32 rather than along the edges of the bottom panel 22.

With reference to FIG. 3, foldable box 10 is illustrated in a partially assembled configuration, wherein the back panel 24 is rotated away from the bottom panel 22 about the foldable connector 44, and the first front panel 20 is rotated away from the bottom panel 22 about the foldable connector 40. In particular embodiments, the rotation of the first front panel 20 and the back panel 24 may occur simultaneously. In some embodiments, the foldable connectors 40, 42 may permit the first front panel 20 and the back panel 24 to rotate from about 1-360° relative to the bottom panel 22, or from about 1-180° relative to the bottom panel 22, or from about 1-90° relative to the bottom panel 22. As seen in FIG. 3, rotating the first front panel 20 and the back panel 24 approximately 90° relative to the bottom panel 22, from their flat position when the box was in its first configuration, allows the foldable connectors 60, 62, 64, 66 to engage the left and right panels 32 of the second sets of panels. As a result, the front panel 20, back panel 24, left panel 30, and right panel 32, are then generally perpendicular to the bottom panels 22 and in a three-dimensional position.

Figure 4:
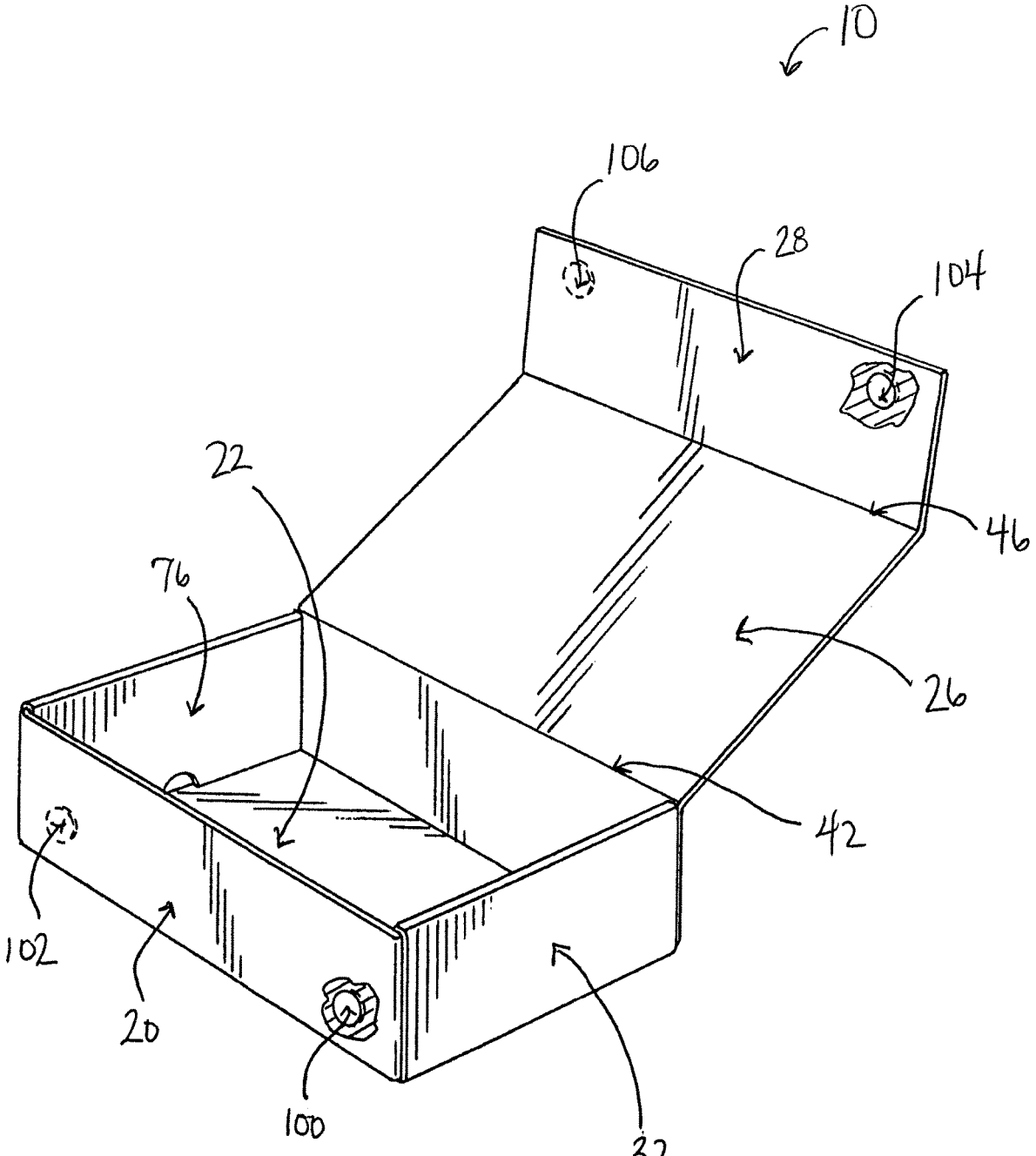
FIG. 4 is a perspective illustration of the foldable box of FIGS. 1-3 in its folded, assembled three-dimensional configuration with the lid open.

Furthermore, in particular embodiments, after the left panels 30 and right panels 32 are rotated to become generally perpendicular to the bottom panel 22 (i.e., in a three-dimensional position), the left-side connection panel 34 can then engage the left panel 30 and bottom panel 22, and the right-side connection panel 36 can engage the right panel 32 and bottom panel 22. For example, with reference to FIGS. 3 and 4, the left-side connection panel 34 may be rotated about foldable connector 54 such that the left-side connection panel 34 is parallel with the left panel 30 and such that the surface 78 of the left-side connection panel 34 contacts the foldable connectors 60, 64 and the surface 78 of the left panel 30. Similarly, the right-side connection panel 36 may be rotated about foldable connector such that the right-side connection panel 36 is parallel with the right panel 32 and such that the surface 78 of the right-side connection panel 36 contacts the foldable connectors 62, 66 and the surface 78 of the right panel 32. In some embodiments, the left-side connection panel 34 and the right-side connection panel 36 may be a part of the one or more release connection arrangements that reversibly connects two or more panels. The folding over of panels 34, 36 as illustrated in FIG. 4 retains panels 60, 62, 64, 66 in the open position so as to prevent the collapsing of the box. When the box is to be unfolded, panels 34, 36 are moved to the position as illustrate din FIG. 3 and the box can thereafter be collapsed and repositioned to the configuration illustrated in FIG. 1 or 1A.

Figure 5:
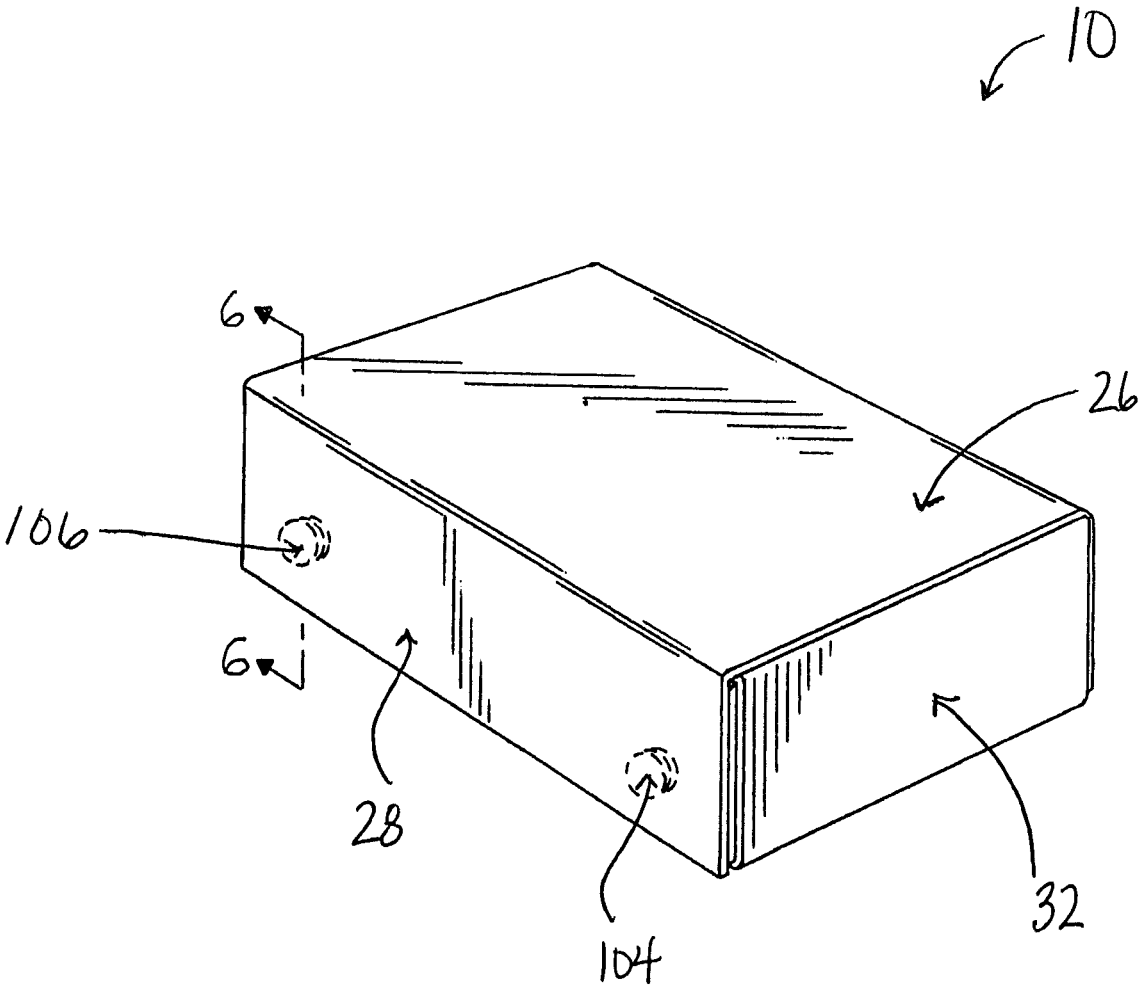
FIG. 5 is a perspective illustration of the foldable box of FIGS. 1-4 in its folded, assembled three-dimensional configuration with the lid closed.

With reference to FIGS. 4 and 5, after the left panel 30 and right panel 32 have been secured, the top panel 26 may then be rotated about the foldable connector 46 towards the first front panel 20 such that the top panel 26 is then parallel with the bottom panel 22. Additionally, the foldable box 10 may include a second releasable connection arrangement reversibly connecting or securing two or more panels, the second releasable connection arrangement including a first connection portion having one or more magnetic elements 100, 102 associated with the first front panel 20, and a corresponding connection portion having one or more corresponding magnetic elements 104, 106. When the top panel 26 is rotated into a position parallel with the bottom panel 22, as seen in FIG. 5, the second front panel 28 may be rotated about the foldable connector 46 to be parallel and adjacent to the first front panel 20. As a result, the magnetic elements of the first connection portion associated with the first front panel 20 can engage the corresponding magnetic elements 104, 106 of the corresponding connection portion associated with the second front panel 28. In particular embodiments, the foldable box 10 as seen in FIG. 5 may be considered to be in its second configuration, a three-dimensional assembled position. As can be appreciated, element 104, 106 can be a magnetic element, and element 100, 102 can be a non-magnetic element, or vice versa. As illustrated in FIG. 5, the elements 104, 106 are spaced equal distances from the side edges of panel 28, and elements 100, 102 are spaced equal distances from the side edges of panel 20. Generally, the spacing between the elements 104 and 106 is greater than the spacing of each element from the side edge of panel 28. A similar spacing configuration typically exists for elements 100 and 102 on panel 20. Also, elements 104 and 106 are located closer to the bottom edge than the top edge of panel 28. A similar positioning configuration typically exists for elements 100 and 102 on panel 20.

Figure 6:
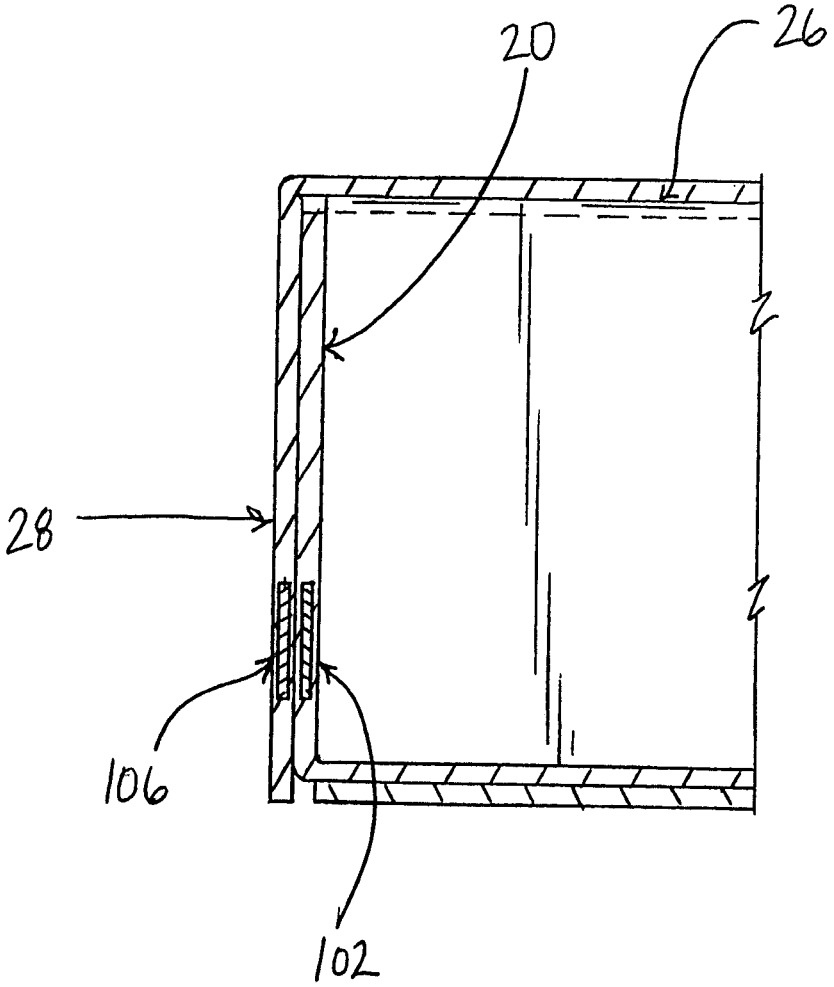
FIG. 6 is a cross-sectional perspective illustration of the foldable box taken along line 6-6 of FIG. 5.

A cross-sectional view taken along line 6-6 in FIG. 5 is illustrated in FIG. 6 in accordance with one embodiment of this disclosure, wherein the releasable connection arrangement portions are reversibly engaged. As a result, the foldable box 10 can be easily and reversibly transformed from its first flat configuration into its second three-dimensional configuration.

Figure 7:
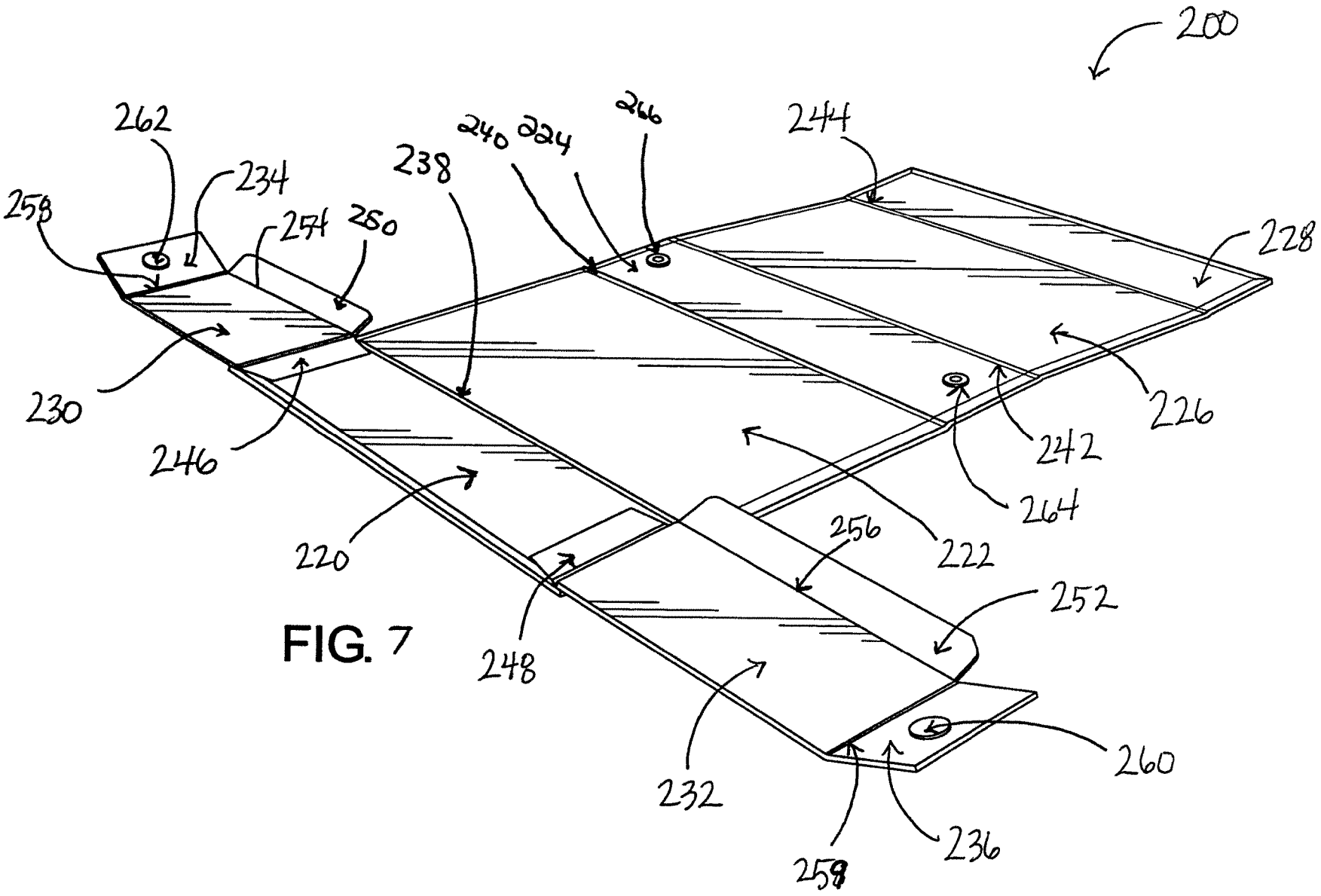
FIG. 7 is a top plan illustration of a foldable box in accordance with another non-limiting aspect of the present invention.

Referring now to FIGS. 7-11, a second non-limiting embodiment of the foldable box 200 is shown in accordance with the present disclosure. The foldable box 200 is shown in FIG. 7 in an expanded, flat layout configuration. The foldable box 200 has a first set of panels including a first front panel 220, a second front panel 228, a bottom panel 222, and a top panel 226, which are irreversibly connected along the foldable connectors 238, 240, 242, 244. The foldable box 200 also includes a second set of panels, including at least a left panel 230 and a right panel 232, which are irreversibly connected to one or more panels of the first set of panels. Also, the panels that form the second set of panels are irreversibly connected together. As such, the box does not include separate unconnected panels that are not connected to at least one other panel of the box.

In some embodiments, the left panel 230 may be connected to the first front panel 220 by the foldable connector 246, and the right panel 32 may be connected to the second front panel 228 by the foldable connector 248. In particular embodiments, the second set of panels may further include a left-side connection panel 234 and a right-side connection panel 236. The left-side connection panel 234 may be connected to the left panel 230 along the foldable connector 258, and the right-side connection panel 236 may be connected to the right panel 232 along the foldable connector 259. The second set of panels may optionally further include additional panels, such as the stabilization panels 250, 252, which can be connected to the left and right panels 232 along the foldable connectors 254,256, respectively.

Figure 8:
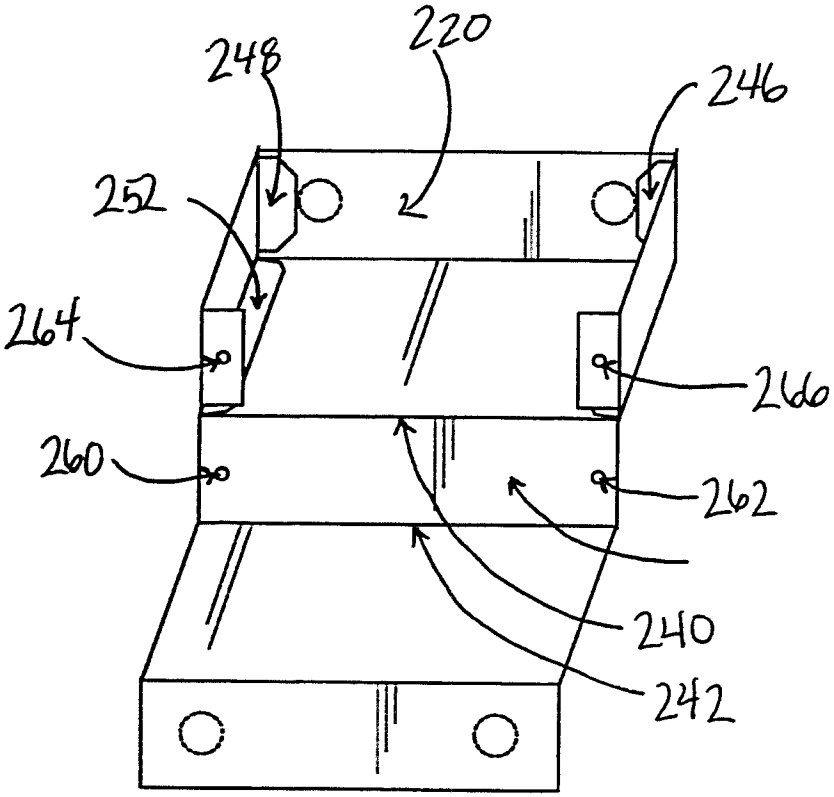

With reference to FIG. 8, the first front panel 220 is rotated about the foldable connector 238 relative to the bottom panel 222, such that the first front panel 220 and bottom panel 222 are substantially perpendicular to each other. The left panel 230 is rotated about the foldable connector 246 relative to the first front panel 220, and the right panel 232 is rotated about the foldable connector 248 relative to the first front panel 220. Left and right panels 230, 232 are generally not releasable from panel 220. The stabilization panels 250, 252 are rotated about the foldable connectors 254, 256 to be parallel and adjacent to the bottom panel 222. The stabilizer panels are generally designed such that they merely rest on the top surface of panel 222, but are not connected to panel 222; however, it can be appreciated that the stabilizer panels can be configured to be releasably connected to panel 222 via a releasable connector (e.g., snap, hook and loop fastener, releasable adhesive, etc.). Additionally, the left-side connection panel 234 and the right-side connection panel 236 are rotated about the foldable connectors 258, 259 to be parallel with the front panel 220.

In particular embodiments, the left-side connection panel 234 and the right-side connection panel 236 may include a releasable connection arrangement having a first connection portion and a corresponding connection portion. As illustrated in FIG. 8, the releasable connection arrangement may be a snap-type configuration. The first connection portion may be one or more sockets 264, 266 associated with the back panel 224, and the corresponding connection portion may be one or more corresponding studs 260, 262 associated with the left-side connection panel 234 and the right-side connection panel 236. The sockets 264, 266 associated with the back panel 224 can engage the studs 260, 262 associated with the panels 234, 236 of the second set of panels to reversibly connect the second set of panels with the back panel 224 of the first set of panels. As can be appreciated, the releasable connection arrangement can alternatively be a hook and loop fastener arrangement wherein sections 260, 262 represent one portion of the hook and loop fastener and sections 264, 266 represent the other portion of the hook and loop fastener. Likewise, a releasable adhesive configuration could be used that does not cause damage when creating and uncreating an adhesive connection. In such an arrangement, sections 260, 262 can represent the releasable adhesive or surface to receive the releasable adhesive and sections 264, 266 can represent the releasable adhesive or surface to receive.

Figure 9:
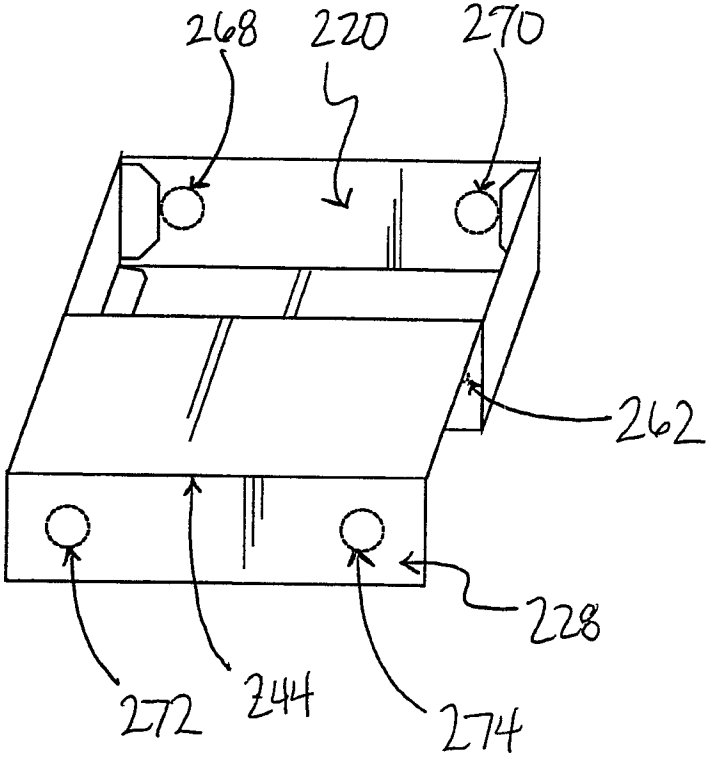
FIGS. 8-9 is a perspective illustration of the foldable box of FIG. 7 in its transition from flat, unfolded configuration into its folded, three-dimensional configuration.
Figure 10:
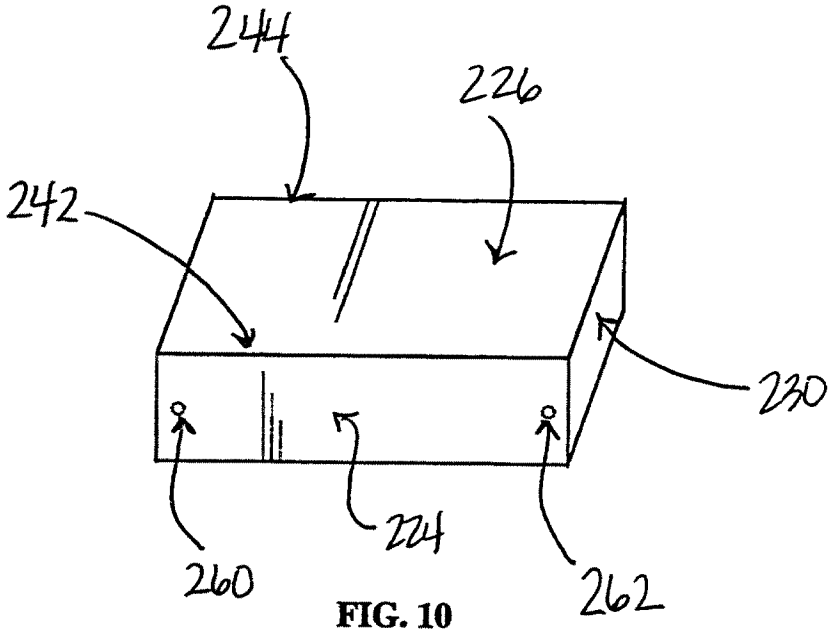
FIG. 10 is a back perspective illustration of the assembled foldable box of FIGS. 7-9.

With reference to FIGS. 9 and 10, the engagement of the releasable connection arrangement is shown. The back panel 306 can be rotated about the foldable connector 240 relative to the bottom panel 304, such that the back panel 306 becomes parallel and adjacent to the left-side connection panel 312 and the right-side connection 314. In this position, the back panel is also parallel to and opposing the first front panel 20, and is perpendicular with the left and right panels 32.

Figure 11:
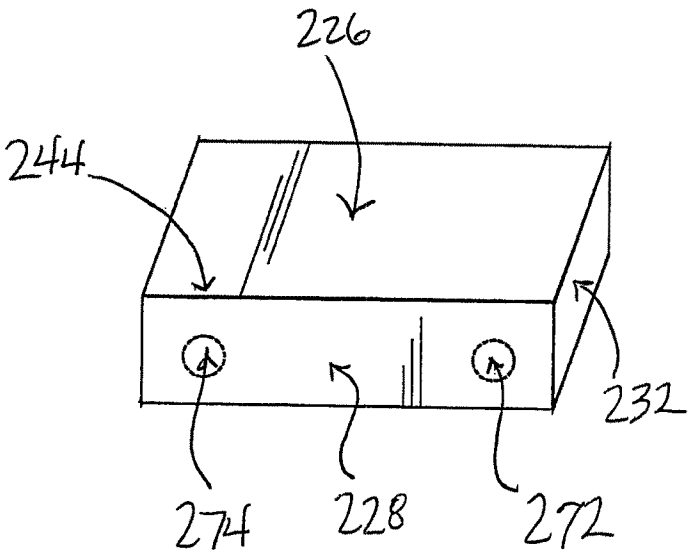
FIG. 11 is a front perspective illustration of the assembled foldable box of FIGS. 7-10.

Afterwards, the top panel 226 may be rotated about the foldable connector 242 to be parallel with and opposing the bottom panel 222. The second front panel 228 may then be rotated about the foldable connector 244 to be parallel with and adjacent to the first front panel 220. In particular embodiments, the foldable box 200 may include a second releasable connection arrangement that connects the first front panel 220 with the second front panel 228 when the box is in its second configuration. In some embodiments, the releasable connection arrangement may include a first connection portion having one or more magnetic elements 268, 270 associated with the first front panel 220, and a corresponding connection portion 272, 274 having one or more corresponding magnetic elements associated with the second front panel 228 When the box is in its second configuration, as seen in FIGS. 10 and 11, the magnetic elements of the first front panel 220 engage the corresponding elements of the second front panel 228, thereby reversibly securing the box in its second configuration. The magnet arrangement can be the same or similar to the arrangement described with reference to the box illustrated in FIGS. 1-6; however, this is not required. As can be appreciated, the disassembly of the box from the folded (FIG. 11) to the unfolded position (FIG. 7) can be easily accomplished by the reversal of the above steps.

Figure 12:
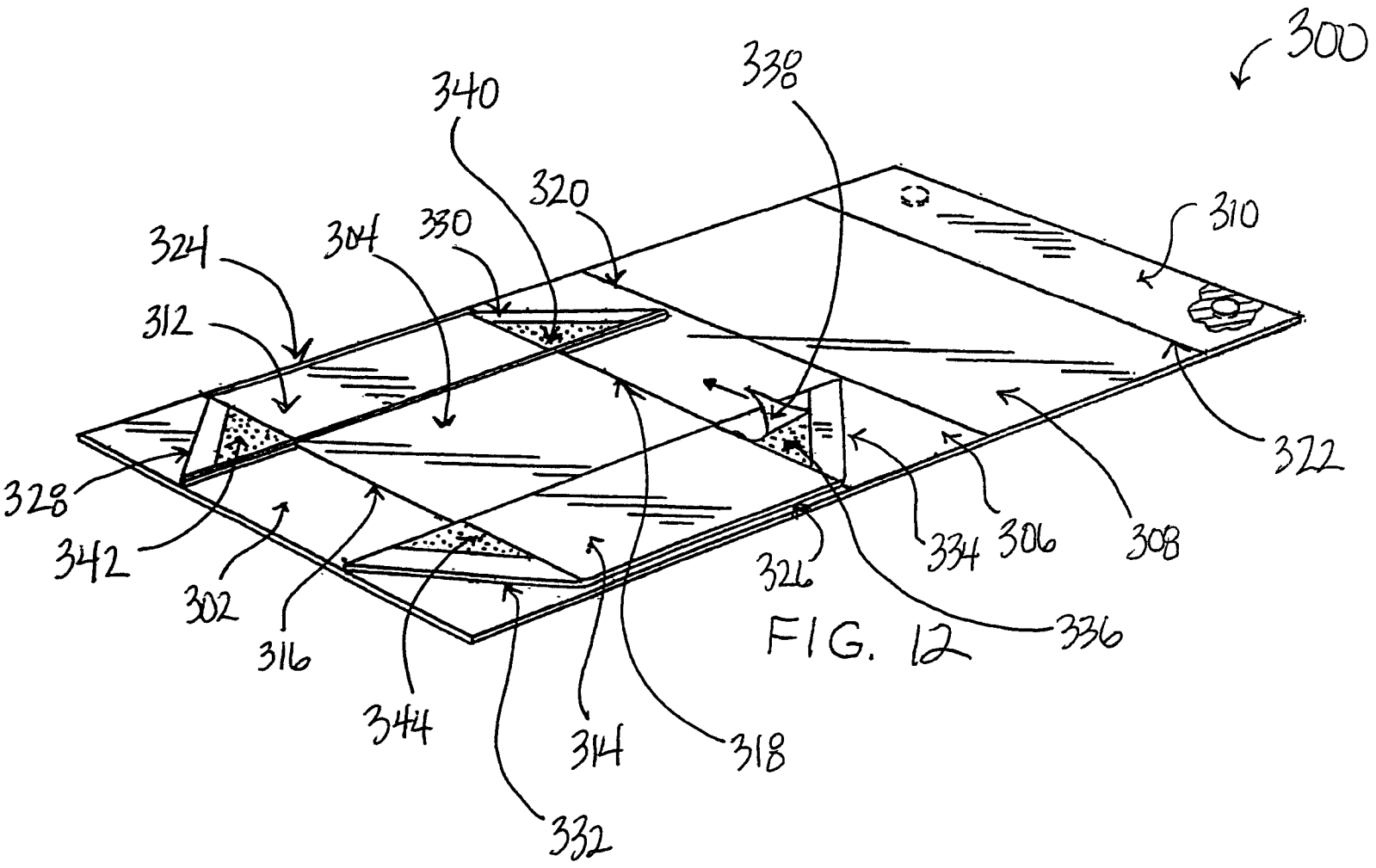
FIG. 12 is a top plan illustration of a foldable box in accordance with another non-limiting aspect of the present invention.

Referring now to FIGS. 12-16, another embodiment of a foldable box 300 is illustrated in accordance with a third aspect of this disclosure. The foldable box 300 is shown in FIG. 12 in an expanded, flat layout configuration. The foldable box 300 has a first set of panels including a first front panel 302, a second front panel 310, a bottom panel 304, and a top panel 308, which are irreversibly connected along the foldable connectors 316, 318, 320, 322. The foldable box 300 also includes a second set of panels, including at least a left panel 312 and a right panel 314, which are connected to one or more panels of the first set of panels. The left panel 312 can be connected to the bottom panel 304 via the foldable connector 324, to the first front panel 302 by the foldable connector 328, and to the back panel 306 by the foldable connector 330. Similarly, the right panel 314 can be connected to the bottom panel 304 along the foldable connector 326, to the first front panel 302 by the foldable connector 332, and to the back panel 306 by the foldable connector 334.

In accordance with this aspect of the disclosure. The foldable connectors 328, 330, 332, 334 may include an adhesive portion 336, 340, 342, 344, which may be covered by a removable cover 338. Thus, when the box is ready to be transformed from its first configuration into its second configuration, the covers (e.g., cover 338) of the foldable connectors 328, 330, 332, 334 may be removed and the adhesive portions 336, 340, 342, 344 used to secure two or more panels of the box 300 together in its second configuration.

Figure 13:
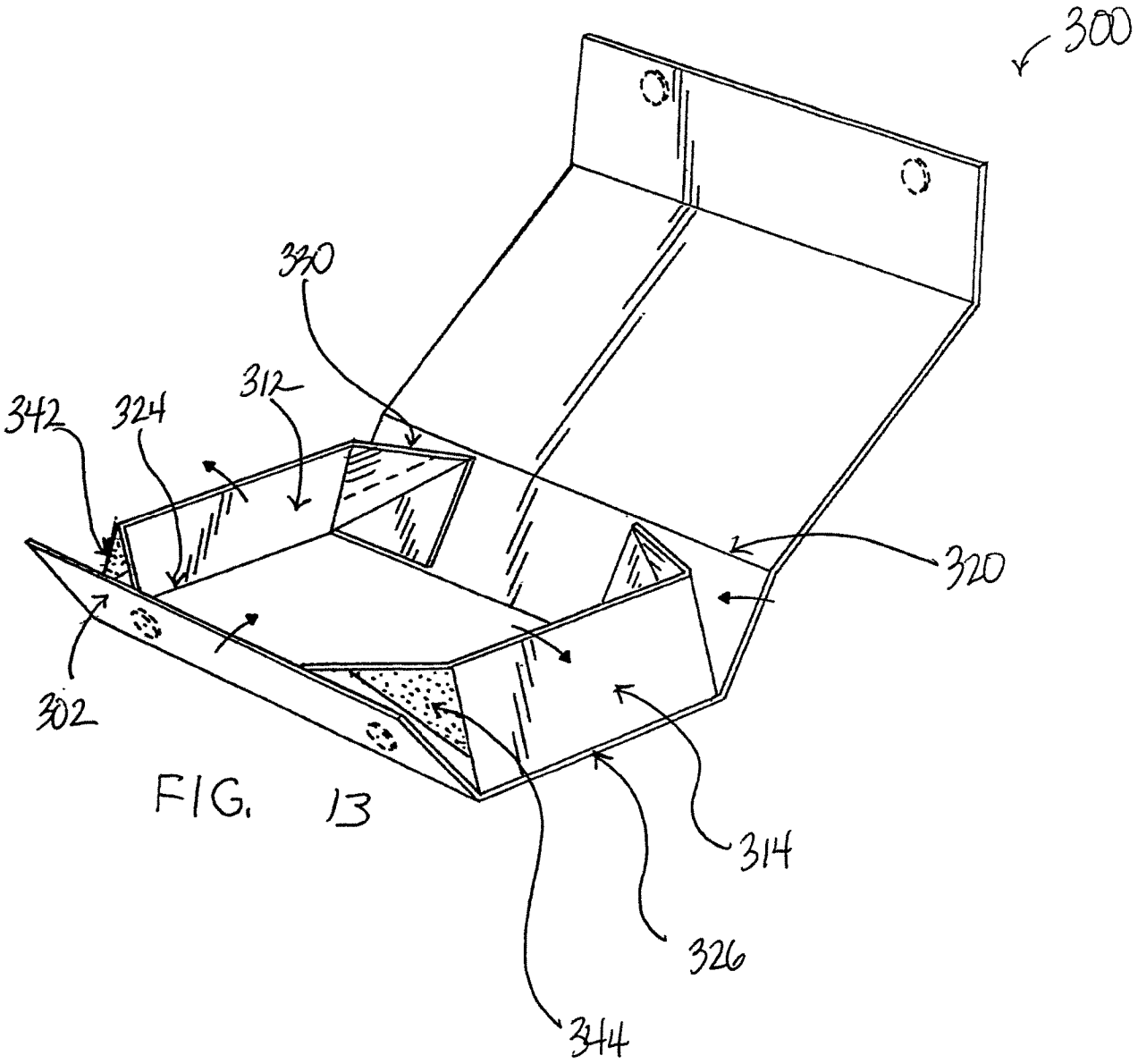
FIG. 13 is a perspective illustration of the foldable box of FIGS. 1-2 in its transition from a flat, unfolded configuration into its folded, three-dimensional configuration.
Figure 14:
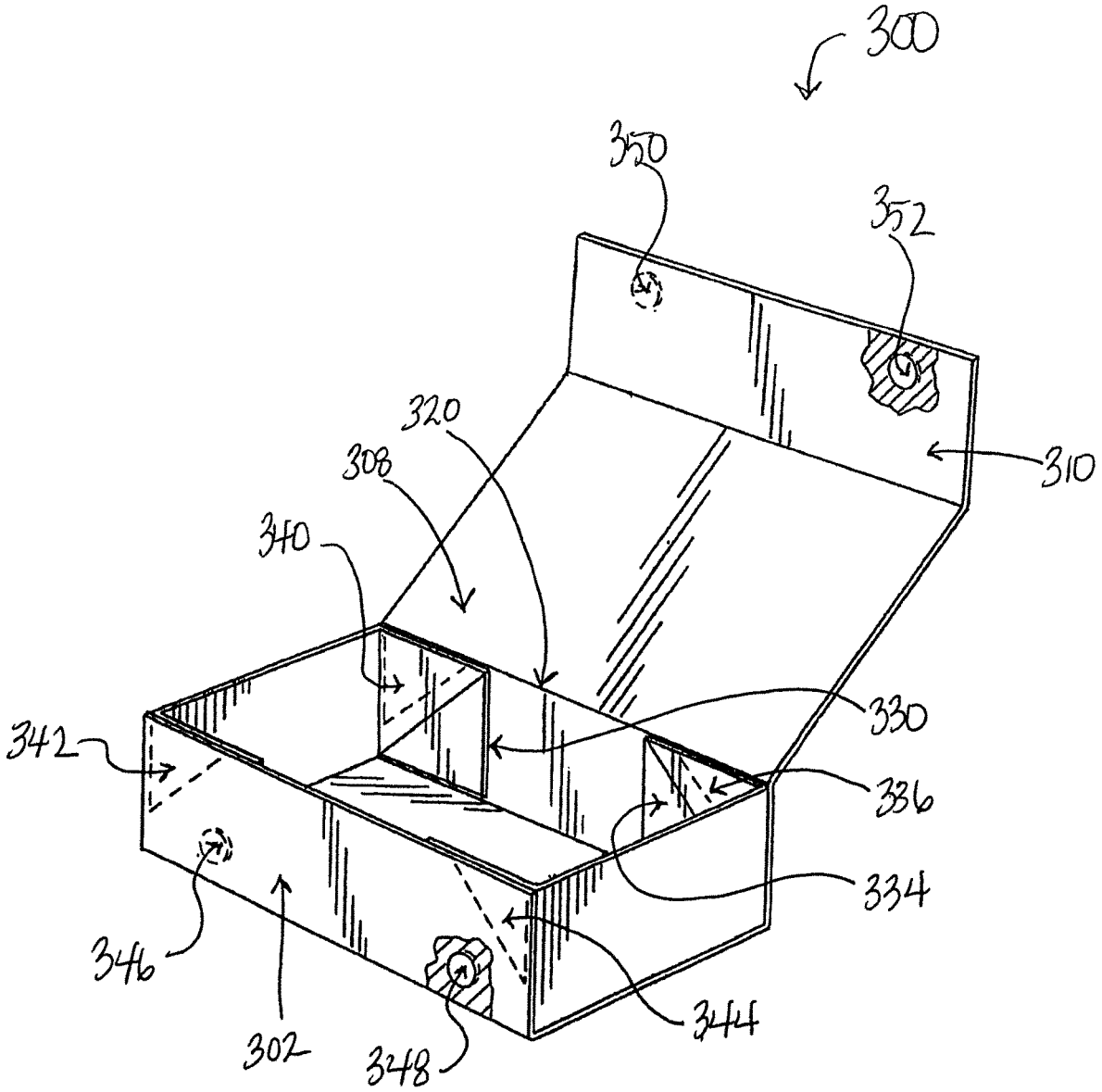
FIG. 14 is a perspective illustration of the foldable box of FIGS. 12-13 in its folded, assembled three-dimensional configuration with the lid open.
Figure 15:
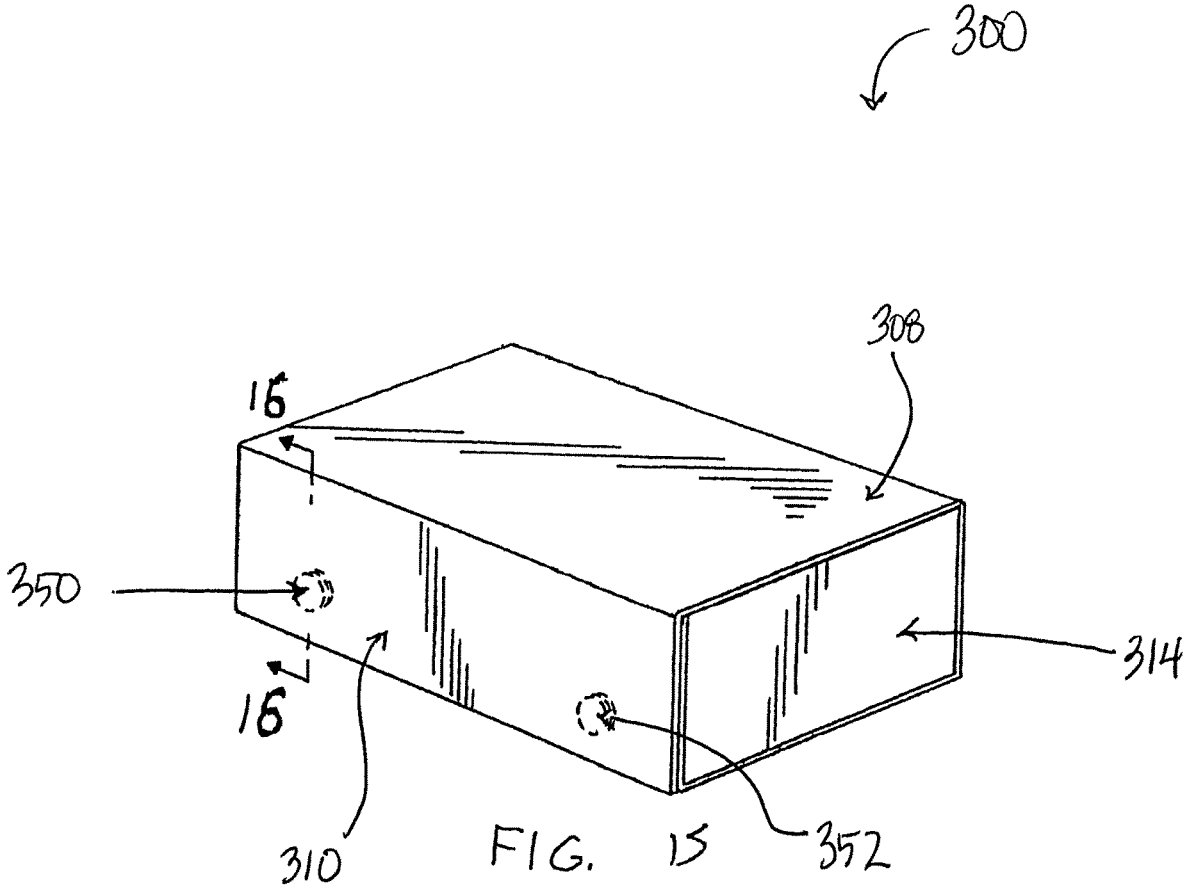
FIG. 15 is a perspective illustration of the foldable box of FIGS. 12-14 in its folded, assembled three-dimensional configuration with the lid closed; and, FIG. 16 is a cross-sectional perspective illustration of the foldable box taken along line 16-16 of FIG. 15.

With reference to FIG. 13, the foldable box 300 is shown in a partially assembled configuration. The left panel 312 is being rotated about the foldable connector 324 from a flat position into a position perpendicular to the bottom panel 304. Similarly, the right panel 314 is being rotated about the foldable connector 326 from a flat position into a position perpendicular to the bottom panel 304. As the left and right panels 314 are rotated relative to the bottom panel 304, the front panel 302 and the back panel 306 can also be rotated relative to the bottom panel 304. The foldable connectors 336, 340, 342, 344 having adhesive portions 336, 340, 342, 344 may contact and thereby irreversibly engage the front and back panels 306, as shown in FIG. 14. Afterwards, the top panel 308 may be rotated about the foldable connector 320 to be parallel with and opposing the bottom panel 304, as seen in FIG. 15. The second front panel 310 may then be rotated about the foldable connector 322 to be parallel with and adjacent to the first front panel 302.

Figure 16:
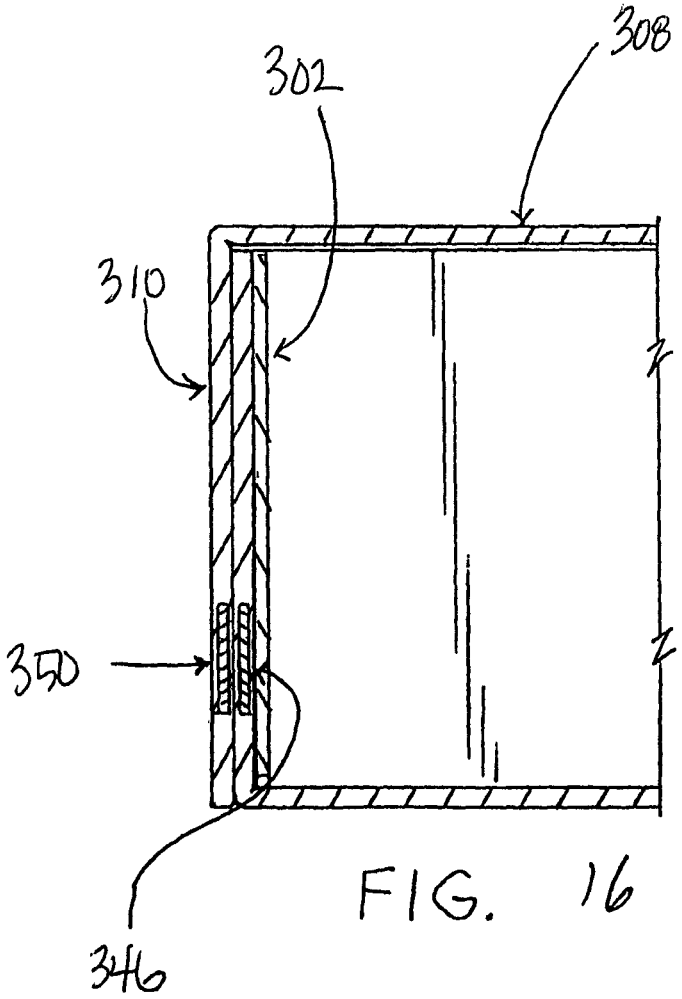

The foldable box 300 can also include one or more releasable connection arrangements. In some embodiments, the releasable connection arrangement can connect the first front panel 302 with the second front panel 310 when the box 300 is in its second configuration. The releasable connection arrangement may include a first connection portion having one or more magnetic elements 346, 348 associated with the first front panel 302, and a corresponding connection portion having one or more corresponding magnetic elements 350, 352 associated with the second front panel 310. When the box 300 is in its second configuration, as seen in FIG. 15 and in the cross-section taken along line 16-16 as shown in FIG. 16, the magnetic elements 346, 348 of the first front panel 302 engage the corresponding elements 350, 352 of the second front panel 310, thereby reversibly securing the box in its second configuration.

In accordance with another aspect of this disclosure, a method of transforming a foldable box 300 from a first folded configuration to a second three-dimensional configuration is provided. In particular embodiments, the method includes: providing a foldable box 300 in a first configuration; rotating one or more of the panels of the foldable box 300 along two or more foldable connectors into an expanded but flat configuration; simultaneously rotating two or more panels of the foldable box 300 from about 1° to about 180° relative to a bottom panel 304 of the foldable box 300; subsequently rotating one or more additional panels along one or more additional foldable connectors; engaging at least one releasable connection arrangement connecting two or more panels of the box and securing such panels in an assembled three-dimensional configuration; rotating a top panel 308 of the box along a foldable connector such that the top panel 308 is parallel and opposing a bottom panel 304; and rotating a front panel of the box along a foldable connector such that the front panel is parallel and contacting an adjacent front panel.

In a first step, a foldable box 300 is provided in a folded and substantially flat configuration. The box can include: 1) a first set of panels comprising a first front panel 302, a second front panel 310, a bottom panel 304, a back panel 306, and a top panel 308, wherein each panel of the first set of panels is irreversibly connected to one or more other panels of the first set of panels; and 2) a second set of panels including a left panel 312 and a right panel 314, wherein at least two panels of the second set of panels are connected to one or more panels of the first set of panels. The box can further include two or more foldable connectors, wherein each connector connects two panels together and permits from about 1° to about 360° of relative rotation between connected adjacent panels. Additionally, the box 300 may also include one or more releasable connection arrangements reversibly connecting two or more panels, each releasable connection arrangement including a first connection portion and a corresponding connection portion. The first connection portion may be associated with at least one panel of the first or second sets of panels, and the corresponding connection portion may be associated with at least one different panel of the first or second sets of panels.

In particular embodiments, each panel of the box 300 is individually formed from a panel material. The first front panel 302 and bottom panel 304 can be irreversibly connected along a first foldable connector 316, the bottom panel 304 and back panel 306 can be irreversibly connected along a second foldable connector 318, the back panel 306 and top panel 308 can be irreversibly connected along a third foldable connector 320, the top panel 308 and the second front panel 310 can be irreversibly connected along a fourth foldable connector 322, the left panel 312 and a first panel of the first set of panels can be connected by a fifth foldable connector 324, and the right panel 314 and a second panel of the first set of panels can be connected by a sixth foldable connector 326.

In particular embodiments, each panel of the box is individually formed from a panel material. The first front panel and bottom panel can be irreversibly connected along a first foldable connector, the bottom panel and back panel can be irreversibly connected along a second foldable connector, the back panel and top panel can be irreversibly connected along a third foldable connector, the top panel and the second front panel can be irreversibly connected along a fourth foldable connector, the left panel and a first panel of the first set of panels can be connected by a fifth foldable connector, and the right panel and a second panel of the first set of panels can be connected by a sixth foldable connector.

In a second step, one or more of the panels of the first and second sets of panels are rotated relative to one or more other panels along the two or more foldable connectors into an expanded but flat configuration. That is, in the first configuration, one or more of the panels of the box 300 can be folded upon an adjacent panel, thereby minimizing the box's physical footprint and maximizing its storability. Prior to fully transforming the box into its second configuration, the box 300 may first be "unfolded" from its first configuration, thereby enabling access to additional panels, foldable connectors, and/or releasable connection arrangements. One or more of the panels may be rotated from about 1° to about 360° from its position in the first configuration to its intermediate position relative to one or more other panels of the box.

In a third step, the left and right panels 314 may be simultaneously rotated along the fifth and sixth foldable connectors relative to the bottom panel 304. In particular embodiments, at least one panel of the first set of panels is also rotated concurrently along the first or second foldable connector relative to the bottom panel 304. The left and right panels 314 may be rotated from about 1° to about 180° relative to the bottom panel 304 of the box. The at least one panel from the first set of panels may also be rotated from about 1° to about 180° relative to the bottom panel 304.

In a fourth step, a second panel of the first set of panels is rotated along either the first or second foldable connector. This second panel may be rotated from about 1° to about 180° relative to the bottom panel 304, and may be rotated into a position that is parallel with and opposing the first panel of the first set of panels previously rotated. In particular embodiments, the second panel may be rotated simultaneously with the left, right, and first panel of the first set of panels, or may be rotated subsequently.

In a fifth step, at least one of the one or more releasable connection arrangements may be engaged, thereby releasably connecting two or more panels together and/or securing two or more panels in a three-dimensional shape (i.e., their second configuration positions). That is, the first connection portion associated with at least one panel of the first or second sets of panels is connected or secured to the corresponding connection portion associated with at least one other panel of the first or second sets of panels. At this point, at least the left, right, first front, back, and bottom panels 304 are secured in their second configuration positions. However, the box may still be opened and/or closed. That is, the top panel 308 and the second front panel 310 may be rotated between an open and a closed configuration.

In a sixth step, the top panel 308 of the first set of panels is rotated along a third foldable connector 320 from about 1° to about 180° relative to the back panel 306 such that the top panel 308 is then parallel to and opposes the bottom panel 304 (i.e., into a closed position).

Finally, in a seventh step, the second front panel 310 of the first set of panels is rotated along a fourth foldable connector 322 from about 1° to about 270° relative to the first front panel 302 such that the second front panel 310 is then parallel and adjacent to the first front panel 302. That is, the top panel 308 and the second front panel 310 are not in a closed configuration, and the box is in its fully assembled second configuration.

In particular embodiments, the method may include engaging at least a second releasable connection arrangement, such as a connection arrangement having two or more magnetic elements associated with the first and second front panels 310. In some embodiments, rotating the second front panel 310 as described in the seventh step may engage or require engaging the second releasable connection arrangement.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed is:

1. A refoldable box comprising:

a first set of panels including a first front panel, a second front panel, a bottom panel, a back panel, and a top panel, wherein each panel of the first set of panels is irreversibly connected to one or more other panels of the first set of panels;

a second set of panels including first and second left panels and first and second right panels, wherein at least two panels of the second set of panels are irreversibly connected to one or more panels of the first set of panels;

two or more first panel foldable connectors, each first panel connector connecting two panels together on said first set of panels;

two or more second panel foldable connectors, each second panel connector connecting two panels together on said second set of panels;

at least ten foldable arrangements, the first front panel and the bottom panel being connected along a first foldable arrangements, the bottom panel and the back panel being connected along a second foldable arrangements, the back panel and the top panel being connected along a third foldable arrangements, the top panel and the second front panel being connected along a fourth foldable arrangements, the first left panel of the second set of panels and the bottom panel of the first set of panels being connected by a fifth foldable connector, and the first right panel of the second set of panels and the bottom panel of the first set of panels being connected by a sixth foldable connector, the back panel and the first left panel of the second set of panels being connected by a seventh foldable connector, the back panel and the first right panel of the second set of panels being connected by an eighth seventh foldable connector, the first front panel and the first left panel of the second set of panels being connected by a ninth foldable connector, and the first front panel and the first right panel of the second set of panels being connected by a tenth foldable connector; and releasable connection arrangements reversibly connecting two or more panels on said first set of panels by one or more arrangements elected from the group consisting of magnetic arrangements, releasable adhesive arrangements, hook and loop fastener arrangements, latch arrangements, and snap arrangements.

2. The foldable box of claim 1, wherein the two or more first panel foldable connectors are at least partially formed from a first liner layer, the first liner layer being formed from a material that is connected to and covering contiguous portions of at least two or more adjacent panels of the first set of panels, the two or more second panel foldable connectors are at least partially formed from a second liner layer, said second liner layer being formed from a material that is connected to and covering contiguous portions of at least two or more adjacent panels of the second set of panels.

3. The foldable box of claim 2, wherein at least one of the two or more first panel foldable connectors is further at least partially formed from a third liner layer, said third liner layer being formed from a material that is connected to and covering contiguous portions of at least two or more adjacent panels of the first set of panels, the two or more second panel foldable connectors are at least partially formed from a fourth liner layer, the fourth liner layer being formed from a material that is connected to and covering contiguous portions of at least two or more adjacent panels of the second set of panels.

4. The foldable box of claim 1, wherein at least one of the two or more first panel foldable connectors permit from about 1-180° of relative rotation between adjacent panels, and wherein at least one of the two or more second panel foldable connectors permit from about 1-180° of relative rotation between adjacent panels.

5. The foldable box of claim 1, wherein the releasable connection arrangement includes a first connection portion and a second connection portion, the first connection portion being associated with at least one panel of the first or second sets of panels, and said second connection portion being associated with at least one different panel of the first or second sets of panels.

6. The foldable box of claim 5, wherein the first connection portion includes one or more magnets and the second connection portion includes one or more corresponding magnets or one or more magnetically-attracted materials.

7. The foldable box of claim 1, wherein a width and height of the first and second front panels is substantially the same.

8. A refoldable box that comprises:

a first set of panels including a first front panel, a second front panel, a bottom panel, a back panel, and a top panel, wherein each panel of the first set of panels is irreversibly connected to one or more other panels of the first set of panels;

a second set of panels including first and second left panels and first and second right panels, wherein at least two panels of the second set of panels are irreversibly connected to one or more panels of the first set of panels;

two or more first panel foldable connectors, each first panel connector connecting two panels together on said first set of panels;

two or more second panel foldable connectors, each second panel connector connecting two panels together on said second set of panels;

at least ten foldable arrangements, the first front panel and the bottom panel being connected along a first foldable arrangements, the bottom panel and the back panel being connected along a second foldable arrangements, the back panel and the top panel being connected along a third foldable arrangements, the top panel and the second front panel being connected along a fourth foldable arrangements, the first left panel of the second set of panels and the bottom panel of the first set of panels being connected by a fifth foldable connector, and the first right panel of the second set of panels and the bottom panel of the first set of panels being connected by a sixth foldable connector, the back panel and the first left panel of the second set of panels being connected by a seventh foldable connector, the back panel and the first right panel of the second set of panels being connected by an eighth seventh foldable connector, the first front panel and the first left panel of the second set of panels being connected by a ninth foldable connector, and the first front panel and the first right panel of the second set of panels being connected by a tenth foldable connector; and a releasable connection arrangement reversibly connecting two or more panels on said first set of panels, the releasable connection arrangement includes a first connection portion and a second connection portion, the first connection portion being associated with the first front panel and the second connection portion being associated with the second front panel, the releasable connection arrangement selected from the group consisting of a magnetic arrangement, releasable adhesive arrangement, hook and loop fastener arrangement, latch arrangement, and snap arrangement.

9. The foldable box of claim 8, wherein the first connection portion includes one or more magnets or one or more magnetically-attracted material, the second connection portion including one or more magnets or one or more magnetically-attracted materials.

10. The foldable box of claim 9, wherein the two or more first panel foldable connectors are at least partially formed from a first liner layer, the first liner layer being formed from a material that is adhesively connected to and covers contiguous portions of at least two or more adjacent panels of the first set of panels, the two or more second panel foldable connectors are at least partially formed from a second liner layer, the second liner layer being formed from a material that is adhesively connected to and coveris contiguous portions of at least two or more adjacent panels of the second set of panels.

11. The foldable box of claim 10, wherein at least one of the two or more first panel foldable connectors is further at least partially formed from a third liner layer, the third liner layer being formed from a material that is adhesively connected to and covers contiguous portions of at least two or more adjacent panels of the first set of panels, the two or more second panel foldable connectors are at least partially formed from a fourth liner layer, the fourth liner layer being formed from a material that is adhesively connected to and covers contiguous portions of at least two or more adjacent panels of the second set of panels.

12. The foldable box of claim 11, wherein a width and height of the first and second front panels is substantially the same.

13. The foldable box of claim 8, wherein the two or more first panel foldable connectors are at least partially formed from a first liner layer, the first liner layer being formed from a material that is adhesively connected to and covers contiguous portions of at least two or more adjacent panels of the first set of panels, the two or more second panel foldable connectors are at least partially formed from a second liner layer, the second liner layer being formed from a material that is adhesively connected to and covers contiguous portions of at least two or more adjacent panels of the second set of panels.

14. The foldable box of claim 13, wherein at least one of the two or more first panel foldable connectors is further at least partially formed from a third liner layer, the third liner layer being formed from a material that is adhesively connected to and covers contiguous portions of at least two or more adjacent panels of the first set of panels, the two or more second panel foldable connectors are at least partially formed from a fourth liner layer, the fourth liner layer being formed from a material that is adhesively connected to and covers contiguous portions of at least two or more adjacent panels of the second set of panels.

15. The foldable box of claim 8, wherein a width and height of the first and second front panels is substantially the same.

16. A refoldable box that comprises:

a first set of panels including a first front panel, a second front panel, a bottom panel, a back panel, and a top panel, wherein each panel of the first set of panels is irreversibly connected to one or more other panels of the first set of panels;

a second set of panels including a first left panel and a first right panel;

two or more first panel foldable connectors, each first panel connector connecting two panels together on said first set of panels;

at least ten foldable arrangements, the first front panel and the bottom panel being connected along a first foldable arrangements, the bottom panel and the back panel being connected along a second foldable arrangements, the back panel and the top panel being connected along a third foldable arrangements, the top panel and the second front panel being connected along a fourth foldable arrangements, the first left panel of the second set of panels and the bottom panel of the first set of panels being connected by a fifth foldable connector, and the first right panel of the second set of panels and the bottom panel of the first set of panels being connected by a sixth foldable connector, the back panel and the first left panel of the second set of panels being connected by a seventh foldable connector, the back panel and the first right panel of the second set of panels being connected by an eighth seventh foldable connector, the first front panel and the first left panel of the second set of panels being connected by a ninth foldable connector, and the first front panel and the first right panel of the second set of panels being connected by a tenth foldable connector; and a releasable connection arrangement reversibly connecting two or more panels on said first set of panels, the releasable connection arrangement includes a first connection portion and a second connection portion, the first connection portion being associated with the first front panel and the second connection portion being associated with the second front panel, the releasable connection arrangement selected from the group consisting of a magnetic arrangement, releasable adhesive arrangement, hook and loop fastener arrangement, latch arrangement, and snap arrangement.

17. The foldable box of claim 16, wherein the first connection portion includes one or more magnets or one or more magnetically-attracted material, the second connection portion including one or more magnets or one or more magnetically-attracted materials.

18. The foldable box of claim 17, wherein the two or more first panel foldable connectors are at least partially formed from a first liner layer, the first liner layer being formed from a material that is adhesively connected to and covers contiguous portions of at least two or more adjacent panels of the first set of panels, the two or more second panel foldable connectors are at least partially formed from a second liner layer, the second liner layer being formed from a material that is adhesively connected to and covers contiguous portions of at least two or more adjacent panels of the second set of panels.

19. The foldable box of claim 18, wherein at least one of the two or more first panel foldable connectors is further at least partially formed from a third liner layer, the third liner layer being formed from a material that is adhesively connected to and covers contiguous portions of at least two or more adjacent panels of the first set of panels, the two or more second panel foldable connectors are at least partially formed from a fourth liner layer, the fourth liner layer being formed from a material that is adhesively connected to and covers contiguous portions of at least two or more adjacent panels of the second set of panels.

20. The foldable box of claim 19, wherein a width and height of the first and second front panels is substantially the same.

21. The foldable box of claim 16, wherein the two or more first panel foldable connectors are at least partially formed from a first liner layer, the first liner layer being formed from a material that is adhesively connected to and covers contiguous portions of at least two or more adjacent panels of the first set of panels, the two or more second panel foldable connectors are at least partially formed from a second liner layer, the second liner layer being formed from a material that is adhesively connected to and covers contiguous portions of at least two or more adjacent panels of the second set of panels.

22. The foldable box of claim 21, wherein at least one of the two or more first panel foldable connectors is further at least partially formed from a third liner layer, the third liner layer being formed from a material that is adhesively connected to and covers contiguous portions of at least two or more adjacent panels of the first set of panels, the two or more second panel foldable connectors are at least partially formed from a fourth liner layer, the fourth liner layer being formed from a material that is adhesively connected to and covers contiguous portions of at least two or more adjacent panels of the second set of panels.

23. The foldable box of claim 16, wherein a width and height of the first and second front panels is substantially the same.

* * * * *